US006655444B2

(12) United States Patent
Goldenberg et al.

(10) Patent No.: US 6,655,444 B2
(45) Date of Patent: Dec. 2, 2003

(54) ROLL OUT SHOWER CURTAIN AND THE USE THEREOF AS AN ADVERTISING DISPLAY FOR THE HOSPITALITY INDUSTRY

(75) Inventors: Shaul Goldenberg, Vaughan (CA); Sean Davies, Vaughan (CA)

(73) Assignee: 420820 Ontario Limited, Vaughan (CA)

( * ) Notice: Subject to any disclaimer, the term of this patent is extended or adjusted under 35 U.S.C. 154(b) by 42 days.

(21) Appl. No.: 09/741,348

(22) Filed: Dec. 21, 2000

(65) Prior Publication Data

US 2003/0070221 A1 Apr. 17, 2003

Related U.S. Application Data

(63) Continuation-in-part of application No. 09/184,029, filed on Nov. 2, 1998, now Pat. No. 6,267,168, which is a continuation-in-part of application No. 09/035,152, filed on Mar. 5, 1998, now Pat. No. 6,209,610, which is a continuation-in-part of application No. 09/962,263, filed on Oct. 31, 1997, now Pat. No. 6,446,696.

(30) Foreign Application Priority Data

Oct. 30, 2000 (CA) ..... 2324815

(51) Int. Cl.[7] ..... A47H 33/00

(52) U.S. Cl. ..... 160/405; 160/DIG. 6

(58) Field of Search ..... 160/23.1, 10, 238, 160/237, 24, 28, 100, 268.1, 271, 272, 273.1, 383, 385, 405, DIG. 6; 40/517, 611, 514, 520; 4/557, 558, 607, 608

(56) References Cited

U.S. PATENT DOCUMENTS

| | | | | | |
|---|---|---|---|---|---|
| 3,205,118 | A | * | 9/1965 | Guffan | 160/237 |
| 3,466,776 | A | * | 9/1969 | Paige | 40/517 |
| 4,078,492 | A | * | 3/1978 | Levy et al. | 160/237 |
| 4,525,946 | A | * | 7/1985 | Olson | 40/514 |
| 4,651,797 | A | * | 3/1987 | Lange | 160/28 X |
| 4,794,715 | A | * | 1/1989 | Cherwin | 40/514 |
| 4,916,764 | A | * | 4/1990 | Meaden et al. | 160/23.1 |
| 5,097,611 | A | * | 3/1992 | Smollar et al. | 40/514 |
| 5,400,848 | A | * | 3/1995 | Gainer | 160/238 |
| 5,443,563 | A | * | 8/1995 | Hindel et al. | 160/238 |
| 5,505,244 | A | * | 4/1996 | Thumann | 160/23.1 |
| 5,681,259 | A | * | 10/1997 | August | 160/10 |
| 5,682,939 | A | * | 11/1997 | Vargo | 160/237 |

* cited by examiner

*Primary Examiner*—David M. Purol
(74) *Attorney, Agent, or Firm*—Neil H. Hughes; Ivor M. Hughes; Marcelo K. Sarkis

(57) ABSTRACT

A method of advertising in a shower for the hospitality industry including providing replaceable advertisements on a shower closure, for example a door, curtain or the like.

9 Claims, 28 Drawing Sheets

ROLL OUT SHOWER CURTAIN AND THE USE THEREOF AS AN ADVERTISING DISPLAY FOR THE HOSPITALITY INDUSTRY

This application is a continuation in part of U.S. patent application Ser. No. 09/184,029 filed Nov. 2, 1998 now U.S. Pat. No. 6,267,168 which is a continuation in part of U.S. patent application Ser. No. 09/035,152 filed Mar. 5, 1998 now U.S. Pat. No. 6,209,610 which is a continuation in part of U.S. patent application Ser. No. 08/962,263 filed Oct. 31, 1997 now U.S. Pat. No. 6,446,696.

FIELD OF INVENTION

This invention relates to a novel method of commercial advertising heretofore unknown and a preferred structure utilized to carry out the method.

BACKGROUND OF THE INVENTION

Marketing and advertising are well known as a means of communicating with the public and particularly a target audience to enable them to make a selection and discriminate between various alternative choices for services and wares. Typically, for example, along the side of a well traveled highway adjacent a large city or between large cites there are often billboards with various advertising information thereon. The billboards usually are changed regularly and the owners of the billboard charges the clients for the advertising space. It would therefore be beneficial if other opportunities of this type could be exploited commercially.

Hotels, motels, lodges and other resorts are always looking for new cost effective ways to improve their efficiency and profitability. However, within the industry there is a limited number of direct advertising opportunities. At present few opportunities exist for direct advertising.

Typically, a shower is enclosed by a curtain, a set of rolling doors, or other various types of closures. As with the linen and towels within the hotel industry, normally the shower curtains are plain and unattractive. Some upscale resorts may have more attractive versions. However, not a lot of attention is paid to the actual shower curtain or closure device as a means of direct advertising and a source of revenue.

Heretofore it is also known to provide a variety of devices for showers as is found in the following patents:

U.S. Pat. No. 4,584,218
U.S. Pat. No. 5,761,751
U.S. Pat. No. 3,836,420
U.S. Pat. No. 5,794,281
U.S. Pat. No. 5,033,132
U.S. Pat. No. 4,916,764
U.S. Design Pat. No. D334,682

Known commercial shower closures, for example curtains, do not contain an advertisement. One intention for this invention would be to provide a new use of a shower which includes a closure for imparting a message to the occupant of for example a hotel room. The hotel may wish to advertise their five star restaurant in a unique manner, for example their menu and include potentially an extremely appealing images of various entrees available at that restaurant. Alternatively, a local cinema complex may wish to advertise the main features at its various theatres. There is essentially therefore provided herewith a heretofore unknown means for advertising directly with the occupant of a room in the hospitality industry.

Normally, a hotel employee may attend to cleaning a washroom when the occupant leaves for the day. This includes cleaning the shower and disinfecting the shower enclosure including the curtain or doors. It would therefore be advantageous to provide a shower curtain which has embedded in the material making up the shower curtain and anti-fungal, anti-mold and anti-mildew compound. It would also be advantageous to provide a roll-out shower curtain that includes waterseals and a wiping blades to wipe the curtain as it is returned to its hidden position when accumulated on a roll tube. It would also be advantageous to provide a roll out curtain panel which is easily changed by the hotel custodian or other personnel.

Nowhere within the prior art to the knowledge of the Applicants, is there provided a method of advertising in the hospitality industry, for example a hotel, resort, lodge, motel or the like, utilizing a shower closure such as a shower curtain, door or the like, for a shower enclosure.

It is therefore an object of this invention to provide a method of advertising heretofore unknown.

It is also an object of this invention to provide the construction of a roll out shower curtain, as a preferred structure for displaying an advertisement, which can be easily and quickly replaced.

It is also considered to be an object of this invention to provide the use of a shower closure as a means of advertising to the public.

Further other objects of the invention will become apparent to those skilled in the art when considering the following summary of the invention and the more detailed description of the preferred embodiments illustrated herein.

SUMMARY OF THE INVENTION

A primary object of this invention is to provide a new use of a shower which includes a closure for carrying and imparting a message to the occupant of a room in the hospitality industry. For example a hotel may wish to advertise their five star restaurant in a unique manner, for example their menu and include potentially extremely appealing images of various entrees available at that restaurant. Alternatively, a local cinema complex may wish to advertise the main features at its various theatres. There is essentially therefore provided herewith a heretofore unknown means of advertising directly with the occupant of a room in the hospitality industry.

According to the primary aspect of this invention there is provided a method of advertising comprising:

i) providing a replaceable advertisement for a closure of a shower enclosure selected from one of the group of a shower door, a shower curtain, a roll out shower curtain, or the like utilized in the hospitality industry;

ii) affixing the advertisement to the closure either directly by manufacturing the closure with the advertisement thereon if the closure is a curtain or by providing displays which may be placed on the shower door if the closure is a door;

iii) displaying the advertisement for a predetermined period of time;

iv) replacing the advertisement as desired wherein an occupant is exposed to a unique form of advertising heretofore unknown. This method finds particular use in commercial installations in the hospitality industry such as hotels, resorts, lodges, motels or the like.

According to another aspect of the invention there is provided a novel use of a commercial shower closure, for example a shower curtain, a shower door, or a roll out shower curtain, wherein said shower closure is utilized as an advertising display, said display being replaceable as desired by the custodian.

By providing such a unique method and commercial use of a shower closure, an opportunity has arisen, similar to billboards, heretofore unknown for the hospitality industry to advertise to the occupants of the suites in a direct manner. The advertising is limited to the creativity of the industry. For example, the hotel could in this way charge any company desiring to advertise its' services or wares within its various suites. For a large hotel therefore having several hundred suites, the opportunity to advertise becomes large. The possibility for advertising in this new way is therefore evident.

It would however be preferred to accommodate quick and easy replacement of advertising displays. In a preferred embodiment a roll out shower curtain is utilized. The advertising message therefore may or may not be permanently in front of the occupant at all times when they are in the bathroom for a short duration or utilizing the shower. Preferably both sides of the curtain are utilized. Although this method contemplates the use of already known devices, it is also preferred to use a roll out shower curtain as will be described hereinafter. Known roll out curtains of any form may also be utilized but it is preferred that the panel on the roll out device be quickly and easily replaced by providing a unique joint disclosed in our co-pending patent application Ser. No. 09/035,152 within the United States of America. By providing the unique construction including a preferably flexible key element located proximate each end of the curtain panel, the element easily engages with a slot provided within both the roll tube and the handle of the roll out curtain assembly. The replacement of the curtain containing the advertisement then becomes quick and simple. One merely removes the old advertisement from the roll out curtain once the curtain is accessible by removing the key element in turn from both the slot in the tube and the handle by sliding the element out of the slot. A replacement curtain containing an advertisement is positioned by joining it with the roll tube and the handle in like manner, by sliding the flexible key element into the respective slots of the tube and the handle. In this manner, an advertising display may therefore be changed quickly and efficiently within an entire hotel complex.

It is desirable to change advertisements on a regular basis so the public does not become bored with the message. In changing the advertising display therefore on a regular basis, indirectly one is also ensuring that a hygienic shower curtain or closure is in position at all times. It has been found with continuous use that shower curtains become "old" and "worn" after approximately three to six months. There is also the risk of having mildew, mold, and potentially fungus appear on the surface of the shower curtain. This problem would be easily rectified by the advertising revenue generated by replacing the panels on for example, the roll out curtains on a regular basis.

In a preferred embodiment we provide a shower curtain which has embedded in the material making up the shower curtain and anti-fungal, anti-mold and/or anti-mildew compound. Preferably the roll-out shower curtain further comprises water seals and a wiping blades to wipe the curtain as it is returned to its hidden position when accumulated on a roll tube carried in the pocket of the frame.

The flexible key element located adjacent each end of the shower curtain panel is taught in our prior referenced United States Patent Application which teaching set out above is hereby incorporated by reference for the United States Patent Office. It is otherwise taught in our other applications worldwide in a preferred embodiment as including a head and a tail separated by a flexible zone which accommodates flexing when the roll out shower curtain is moved between the operative and inoperative positions. By operative, it is meant that the shower curtain is rolled out and latched in position for use as a water barrier. By inoperative position, this is considered to be when the shower curtain is fully accumulated and hidden on the roll tube.

In our prior co-pending application we disclose a screen assembly and method of manufacture it pertaining to windows. We have found that the structure thereof also has advantages in other roll-out structures such as blinds, panels, and shower curtains. Through this disclosure whenever the term "screen" or "mesh" or "roll-out screen" or the like are used it may be assumed that the terms blind, panel and curtain (preferably a shower curtain) equally apply.

In our prior co-pending application structure we taught one aspect of the invention, wherein there is provided a method of assembling a retractable screen/blind/curtain/panel cassette comprising:

(1) providing a tube upon which said screen/blind/curtain/panel will coil up in use, (2) providing a pin assembly insertable into the open ends of said hollow tube and being prevented from rotating with respect to said tube as ribs disposed with said tube, engaged ribs disposed with said pin assembly, (3) providing a torsion spring having ends which are engageable with at least one of said pin assembly ends for providing the correct torsion and tensioning of said spring, (4) inserting said spring within the hollow tube and inserting said pin assemblies within said hollow tube and fixing the preferred one end of said pin assembly to the tyne portions of said torsion spring, (5) providing brackets from which said pin assemblies will be adjustably inserted, said brackets being locked in place with respect to the assembly, preferably either by engaging with a detent provided with a flexible cover or alternatively by engaging with the bottom pocket of the framing section, (6) adjusting said brackets in relation to the distance from one another so as to correctly tension and carry the screen/blind/curtain/panel assembly, (7) fixing said screen/blind/curtain/panel on said screen/blind/curtain/panel assembly by anchoring said screen/blind/curtain/panel to said tube via a detent, preferably a T-shaped detent or key for engaging with a key slot on the tube or alternatively by using welding or adhesive, and coiling said screen/blind/curtain/panel upon said tube, (8) fixing said opposite end of said screen/blind/curtain/panel to a handle portion either preferably by a T-shaped detent engaging a T-shaped detent with said handle, or by welding or an adhesive, (9) coiling said screen/blind/curtain/panel upon said tube,

(10) preferably engaging said cover portion with said brackets,

(11) inserting said screen/blind/curtain/panel assembly within a pocket of said closure assembly in one of the framing portions thereof,

(12) covering said pocket with a flexible cover.

In our prior co-pending disclosure there was also taught a method of manufacturing a screen/blind/curtain/panel roller assembly comprising the following steps:

1) forming a screen/blind/curtain/panel from suitable screen material such as fiberglass and preferably coating said screen with vinyl, 2) forming a generally key-shaped anchor for said screen/blind/curtain/panel preferably from polyvinyl chloride, preferably said key having a head and a leg comprising two portions and a connector connecting said leg to said head, preferably said head being generally T-shaped,
3) separating the two leg portions for receiving the edges of said screen/blind/curtain/panel,
4) radio frequency welding said leg portions capturing said edges of said screen/blind/curtain/panel and preferably melding said vinyl of said screen/blind/curtain/panel with the PVC of said key,
5) forming a continuous screen/blind/curtain/panel to be accumulated on a roll as roll stock to be supplied to the window manufacturer or repair organization, wherein at any time a predetermined amount of screen/blind/curtain/panel may be payed off the roll stock roll sized to a predetermined window opening size which may be easily assembled with the spring-biased roller upon which the screen/blind/curtain/panel will accumulate by a manufacturer or by a repair person and which also may be engaged with the handle portion proximate the other edge of said screen/blind/curtain/panel, both said roller and said screen handle including a compatibly shaped generally key-shaped receiving portion to receive the head of said key for easy installation or replacement thereof.

It is important that the legs of the key portion be separated from the head portion by a flexible extension to allow for the accommodation of stretching in the screen assembly at that particular location when assembled without destroying the screen. It has been found that the screen when melded together with the PVC key has considerably more strength than the known methods of taping and gluing screen edges to rollers and handle portions. The flexibility is provided by the flexible key shape and material. Any suitable material can be utilized including those materials which readily accept hot welding. However, radio frequency welding is preferred because one does not have to allow for creeping of the material and the allowances of temperature differentials. Cold dies may be provided which come together to provide a reliable joint which may be accurately controlled.

It was also described in our prior co-pending application that we provided a roll of improved continuous screening is provided comprising a preferably "T" shaped edge preferably formed from tough flexible material fused to the screen/blind/curtain/panel material along the edges of the screen/blind/curtain/panel to which a handle and roller drum are to be fixed, preferably said "T" edge being provided proximate both edges of a continuous roll of mesh. Since any excess screen material is stored on a screen roller making up the screen assembly as previously described one may only need as little as one or two standard widths of screen size to service the industry. The other dimension is cut to length and need not be accurate as it rides in a track in the window assembly.

To produce a screen one cuts from roll stack the "T" edge screen to fit inside the frame opening of the window allowing for the guiding track depth less any clearances required. The roller drum and handle are cut to screen length providing for clearance as required. The "T" edge of the cloth is slid into the drum slot and the other "T" end being slid into the handle slot thereby fixing the screen to the critical components. A telescoping glide with its own "T" slot groove supports the screen in the guide track at each end thereof and allows the glide the freedom to move back and forth on the "T" edge of the screen taking up the opening tolerance.

Because the "T" edge is flexible and able to stretch, any local load on the screen cloth will distribute itself over a wide range of fibers of the screen thus improving the impact and tear resistance of the system. In the event that screen was pushed it would pay out the stored material to the end limit reducing dramatically the stress forces on the system. With the high tensile capability of the "T" edge system, the risk of failure of the system is greatly reduced. In servicing a screen that is already installed on site, a bolt of screen cloth carried by the service person need only be cut to the right length, the cover removed from the system to give access, the old screen cloth slide out and the new screen cloth rethreaded. There is no need for any other component replacement if they are sound.

In a preferred embodiment the "T" shaped key may further comprise a "T" head, which will hold the screen into a compatible substantially dovetail-like groove disposed with the roller and/or the handle, a fusing zone where the screen is fused to the "T" with the head being preferably a min. 0.375 inches, and a body zone between the head and the fusing zone with no screen material for providing the flex and stretching of the screen. It is important that the screen cloth be integrally fused to the key over some distance to achieve maximum strength.

The screen is self storing within the frame of the window by virtue of accumulating on a roller similar to the operation of a roller blind. It is payed out by pulling on a full length handle which is guided by a rail at each end. The window frame includes a guide channel for the screen which tracks and covers the free edges of the screen. The handle provided with the screen engages the adjacent sash frame section with latch detents provided which will maintain the screen under tension from the dispensing drum and covers the opening created when the sash is opened by sliding in the track wrinkle free and bug tight.

Therefore as taught in our co-pending application there is provided a continuous roll of screen which may be payed out from said roll by an installer or manufacturer to a required predetermined window size, or alternatively patio door size, said screen comprising a free end which allows the installer to pay the screen off of the roll upon which the screen is accumulated course upon course, one end of said screen being disposed at the end of the courses accumulated on the roll from which the screening is payed off and the other end being a free end, said screen having side edges and preferably being manufactured from preferably vinyl-coated fiberglass, the edges of said screen having affixed thereto a generally preferably T-shaped key manufactured from a flexible material, for example polyvinyl chloride, which is affixed preferably by radio frequency welding (or RF welding) with the edges and preferably each of the edges, and in one embodiment at least one edge of said screen, wherein the vinyl coating provided on the screen melds with the polyvinyl chloride key to form a resilient anchor for the screen device within any screen roller assembly. Preferably the polyvinyl chloride preferably generally T-shaped key has a head extending from a leg in the shape of a preferred T, or alternatively a Y, or any other convenient shape so long as said shape is compatible with the receiving groove on the handle and roller tube, the leg of said key preferably including two separable portions within which the edges of a screen interfit prior to RF welding. The screen is payed off of the roll upon which it is accumulated to the desired dimension of the window or closure such as a patio door wherein the screen will be installed, said screen being cut at that predetermined length cutting also the key proximate at least one end of said screen, said screen thereafter being installed in the screen assembly or alternatively replacing the existing screen in a convenient quick replaceable format. Preferably the generally key-shaped edge portion of the screen having the two legs which capture the screen therebetween prior to RF welding includes an extension portion between the head of the preferably T-shaped key and the two portions capturing the screen and said extension not being RF welded to the screen. This extension portion is utilized to provide a flexible zone and accommodates flexing in the screen assembly in a zone other than the screen. This zone is designed to stretch a predetermined amount and thereby minimize tearing of the screen when subjected to a tensioning load. In a preferred embodiment, the screen which is cut to size for the assembly is installed in a screen assembly with one of the keys being installed in a preferably spring-biased roller upon which the screen will accumulate, and the keyed edge remote said roller is attached to a handle, said roller and said handle each having a compatibly-shaped groove, channel or recess disposed therein to capture the key portion proximate the edges of said screen. In a preferred embodiment, the screen is included in a screen roller assembly embodying a cassette which is installed within a pocket defined in a closure assembly of any of the closure assemblies defined above in any of the apparent applications which are hereby incorporated by reference. The screen assembly may also be utilized in known conventional window assemblies. The pocket provided in the window frame is sized of a predetermined shape to accept the roller screen assembly which includes all of the necessary mounting pivots and preferably the mounting brackets to mount the roller screen assembly within the pocket in the window frame and preferably proximate the inside corner of the jamb or sill or header, depending on whether the window is a tilt-and-slide window or a double-hung window.

The details therefore of our prior co-pending application equally apply to the present inventions being disclosed.

According to yet another aspect of the invention there is provided a roll out shower curtain assembly preferably for the hospitality industry adapted to be installed within a shower enclosure including a base (for example, a tub or a floor pan) said base being separated by substantially vertical walls, said roll out curtain shower assembly comprising a frame, said frame being formed from standard sections in one embodiment including a first and second section, said standard and preferably said first section having an interior and providing a hollow thereat within which said roll out shower curtain is contained and preferably said second section covering the hollow and enclosing it, preferably said first section including within the interior thereof hook portions for engagement with compatible hook portions disposed with the second section to allow for mutual engagement of the hooking portions to retain the first and second sections together without fasteners, said standard section and preferably said first section also having disposed within the hollow thereof parallel rails raised from the interior thereof separated by a predetermined space, said rails for receiving a substantially L-shaped bracket (preferably including an integral preferably conical pivot pin) adapted to fit between said rails of adjacent sections, which are preferably mitered so as to interfit without the need of fasteners, said roll out screen including, a roll tube having a slot extending therein, and a handle having a slot extending therein, and a shower curtain panel having two ends, and having disposed proximate each end a preferably flexible key shaped element (preferably having a head and a tail separated by a flexible zone so as to prevent tearing when the screen is moved to the operative position, preferably said tail including a Y-spaced member including two portions separated by a space for a receipt of the end of the shower curtain panel and for high radio frequency welding of the end of the panel with the flexible key shaped element proximate the tail thereof so as to meld with one another providing a strong joint), said key shaped element for engaging with the slot of the roll tube and the handle, preferably said handle having disposed proximate each end thereof a guide being preferably adjustable and to be contained within a guide track disposed with the standard section and preferably between the first and second sections, to guide the handle to and from the operative position, wherein said roll out screen assembly may be quickly assembled and installed adjacent a shower enclosure preferably without the need for fasteners.

In the preferred embodiment the entire roll out shower curtain assembly can be assembled a the site from a kit of components for a standard sized bath tub or shower enclosure, and when the tub surfaces and the vertical wall surfaces of the enclosure are clean, two sided tape may be laid down and the frame may be placed on the tape in it's final position. All that is left is for the installer to lay down a bead of silicone proximate the inside and outside of the frame. The aforementioned method may therefore be practiced with the preferred roll out shower curtain assembly. The aforementioned use of a shower closure for a shower enclosure in the hospitality industry therefore may also be pursued with the preferred roll out shower curtain assembly.

According to another aspect of the invention there is provided a method of displaying an advertisement in the hospitality industry comprising:

i) Providing a roll out structure, (preferably a shower curtain), that provides a flat planar surface on a flexible panel;

ii) Providing a replaceable advertisement on at least one surface of said panel;

iii) Providing each edge of the panel with a preferred flexible connector;

iv) Providing a handle and roll tube to attach to the panel via the preferred flexible connector;

v) Displaying the replaceable advertisement by moving the panel to an operative position;

vi) Replacing the panel when desired by removing the connector from the handle and roll tube.

wherein the advertisement may be conveniently displayed and replaced as desired.

Preferably the use of the shower curtain closure (such as a curtain, or door) is in the hospitality industry for displaying replaceable advertisements to the public.

Preferably the method of advertising in a shower is for the hospitality industry comprising providing replaceable advertisements on a shower closure for example a door, curtain or the like.

According to yet another aspect of the invention there is provided a substantially L shaped bracket having a first and second diverging legs extending at substantially right angles to one another, said bracket including an integral preferably conical pivot pin disposed on either diverging leg, said pin for accommodating a pivoting member thereon in use. Preferably said bracket with said pin is utilized for retaining a roll tube for a blind, screen, curtain or the like. In a preferred embodiment said bracket is used for a roll out shower curtain assembly.

DETAILED DESCRIPTION OF THE INVENTION

It should be appreciated that the essence of the present invention is the use of a closure for a shower enclosure in the hospitality industry as an advertising display. Any message, illustration, photograph, sketch, list, index, directory or the like may be applied to, the shower curtain of FIG. 2, the shower door of FIG. 3, or the roll out shower curtain of FIG. 4. In each and every case the method and use of the invention is being pursued. It is not necessary that the preferred roll out curtain assembly be utilized in carrying out the method although it will provide for a much cleaner package having the panel containing the advertisement which is easily replaceable. The advertisement on the roll out curtain can be much larger than that provided for shower doors and which does not tend to droop and fold in the case of known hanging shower curtains. However, the use of those two alternative structures are considered to be part of this invention.

Figure 1:
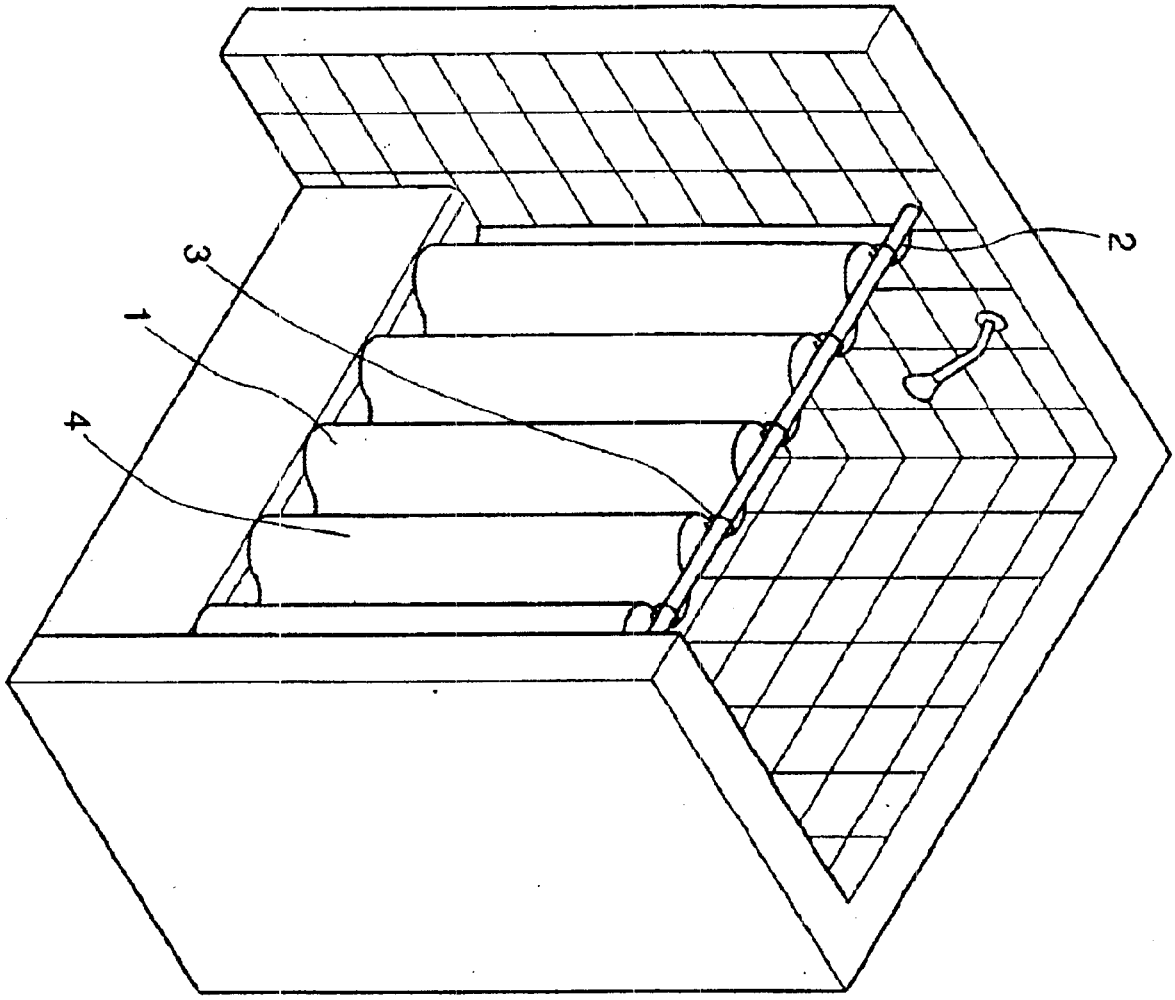
Figure 1 PRIOR ART
FIG. 1 is a shower curtain as is known in the art.

Referring now to FIG. 1. There is illustrated a prior art shower curtain (1) hung from a supporting rod (2) by hooks (3) having a surface (4) which typically has a print thereon or is plain. It is also the case that novelties such as cartoon characters may be placed on the surface.

Figure 2:
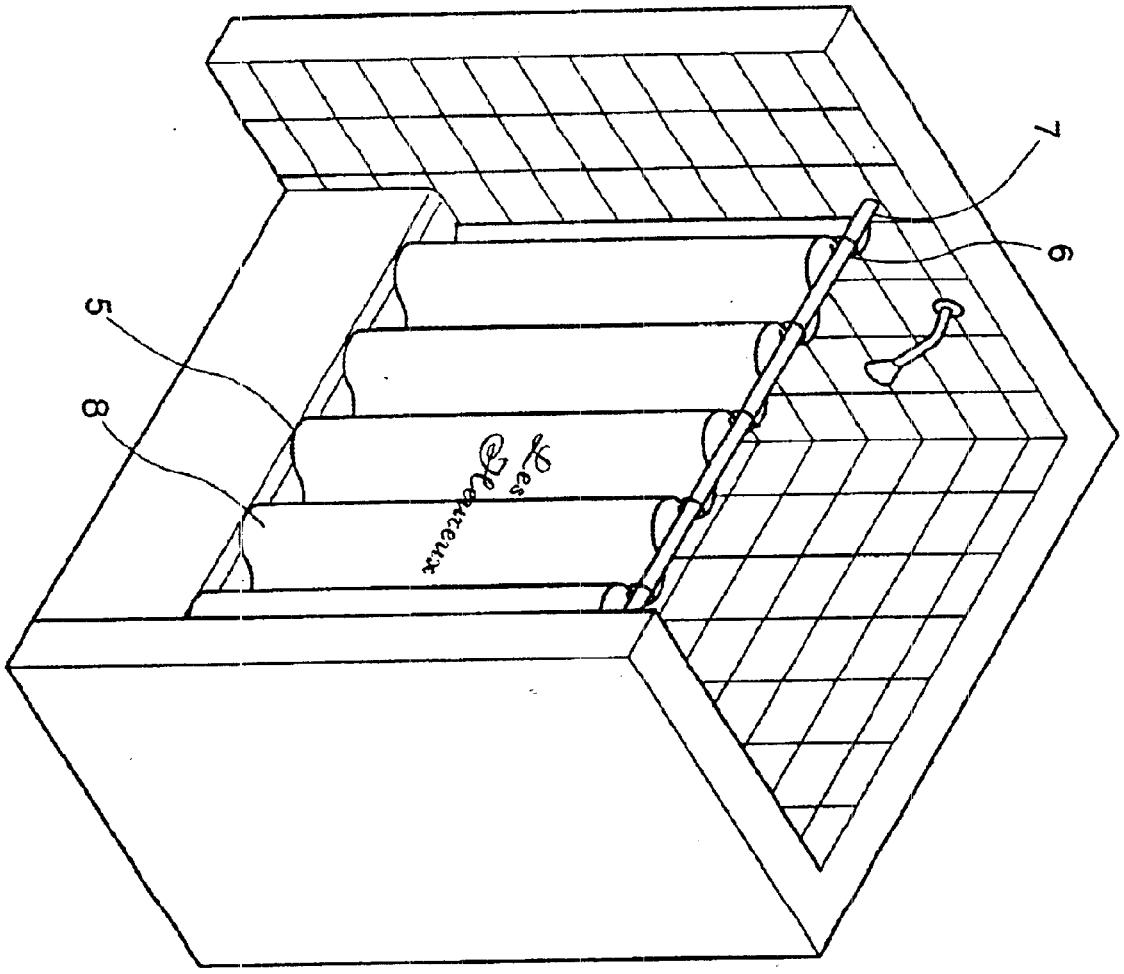
FIG. 2 is a shower curtain utilized with the method of the present application and illustrated in one embodiment of the invention.

Referring now to FIG. 2, there is shown a shower curtain (5) suspended from hooks (6) from a rod (7) having a surface (8) upon which is displayed an advertisement. The advertisement on surface (8) therefore will be displayed typically in a hotel or the like and may be replaced from time to time as desired. The advertisement may appear on both sides of curtain (5), each surface containing a different display.

Figure 3:
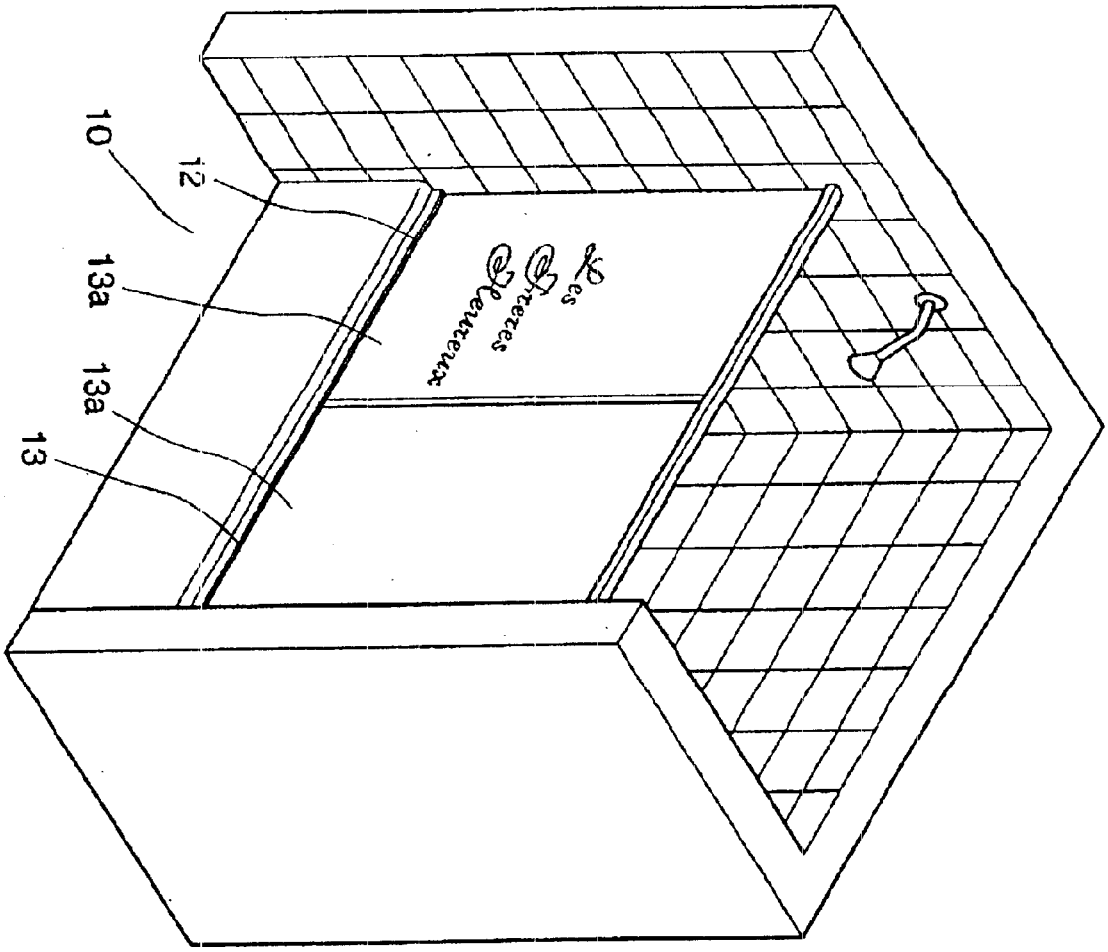
FIG. 3 is a shower door utilized and carrying out the method in another embodiment of the invention.
Figure 4:
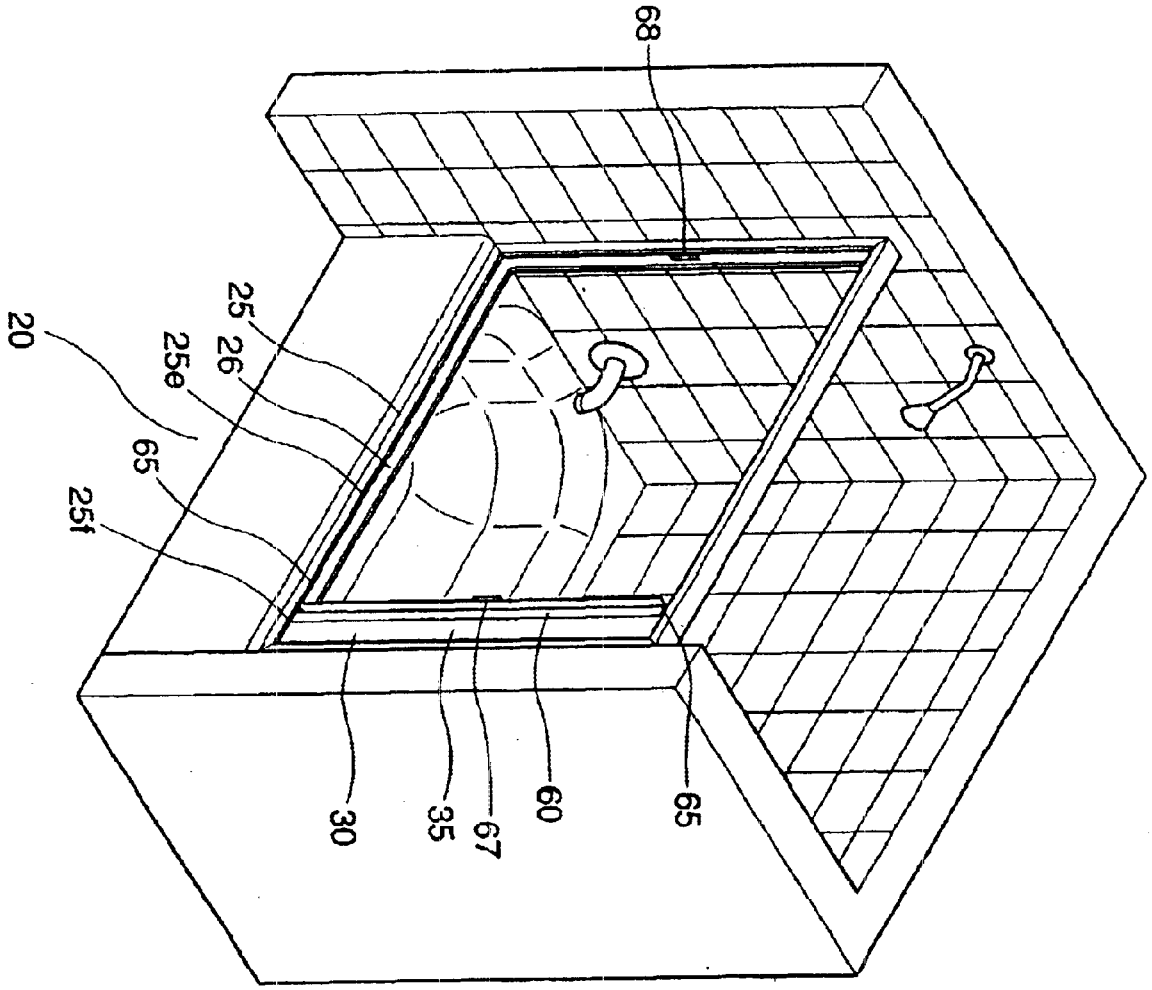
FIG. 4 illustrates a roll out shower curtain assembly installed within a tub enclosure in a preferred embodiment of the invention.

Referring now to FIG. 3, there is illustrated a shower door system (10) which includes a frame within which shower doors (12 and 13) move. The shower doors (12 and 13) include a planar surface (12*a*and 13*a*) typically made from glass which includes an advertisement on both surfaces or alternatively on one or the other. The advertisement on surfaces (12*a*and or 13*a*) may be readily replaced by providing strippable glue on one side of the advertisement, the glue being similar to that of strippable wall paper. In this manner the advertisement may be readily replaced as desired. The advertisement shown in the figure "Les Freres Heureux" may be any convenient message or image which is to be displayed by the proprietor. In this example, a french restaurant is being advertised.

Referring now to FIGS. 4 through 11, there is illustrated a roll out shower curtain assembly (20) including a substantially U-shaped framing section (25) and a cap section (26). The U-shaped section includes on the interior surface (25*f*) proximate the bottom thereof, guide rails (25*a*) separated by a space set at a predetermined distance and for receipt of a substantially L-shaped bracket (27) proximate legs (27*a*and 27*b*). The rails (25*a*) are separated by a space equivalent to the width of the leg (27*a*or 27*b*) so as to snap fit into position. The bracket 27 may be manufactured from plastic and include a conical pin P integral therewith for allowing insertion, retention and pivoting of the brackets carrying tube 50 of the assembly 30. Therefore sections (25) adjacent to one another may be interconnected using only the substantially L-shaped bracket (27) when the legs (27*a*and 27*b*) are placed and snap fit within the space provided by the rails (25*a*). The ends of sections (25) may or may not be mitered at substantially 45 degrees. In this manner the frame sections can be fully assembled. It should also be noted that within the interior of the framing sections (25) of FIGS. 8B and 8C there are included hook portions (25*b*and 25*c*) which provide for clipping engagement with the cap portion (26) of FIGS. 9B and 9C proximate hook portions (26*b*and 26*c*) of the cap section (26). The cap section (26) will therefore clip into position without the need for fasteners as well as is the case also for the cap of FIGS. 9 and 9A which interfit as shown in like manner with the U sections of FIGS. 8 and 8A. Between the cap section (26) and the edge (29) of section (25) and edge (28) of section 26 is found when assembled a guide channel (25*e*) which provides for guided movement of the glide 65 and handle 60 and of the roll out screen (30).

The curtain (30) therefore includes a panel (35) having ends (35*a*and 35*b*) to which are attached flexible key elements (40) having a head (41) and a tail (42) including legs (42*a*and 42*b*) between which the panel (35) is captured and high radio frequency welded to the PVC material making up the flexible element (40). The key end (41) of element (40) fits within a slot (51) of tube (50) and a slot (61) of a handle (60). When assembled the panel (35) is connected to the tube (50) via slot (51) proximate the keyed head of the flexible connector and similarly to the handle portion (60) via slot (61) approximate the keyed head of flexible connector (40). In this regard please refer to FIGS. 17 through 19 and the descriptions related thereto from our prior application.

The handle portion has extending from the ends thereof adjustable glides (65) which ride within the guide (25*e*) of the framing section when the roll out screen moves to and from its operative position. The handle portion (60) also includes a latch portion (67) which is known in the art which latches to a latching plate (68) provided on an opposite framing section from the hollow in which the roll out screen (30) is disposed in use.

Figure 7:
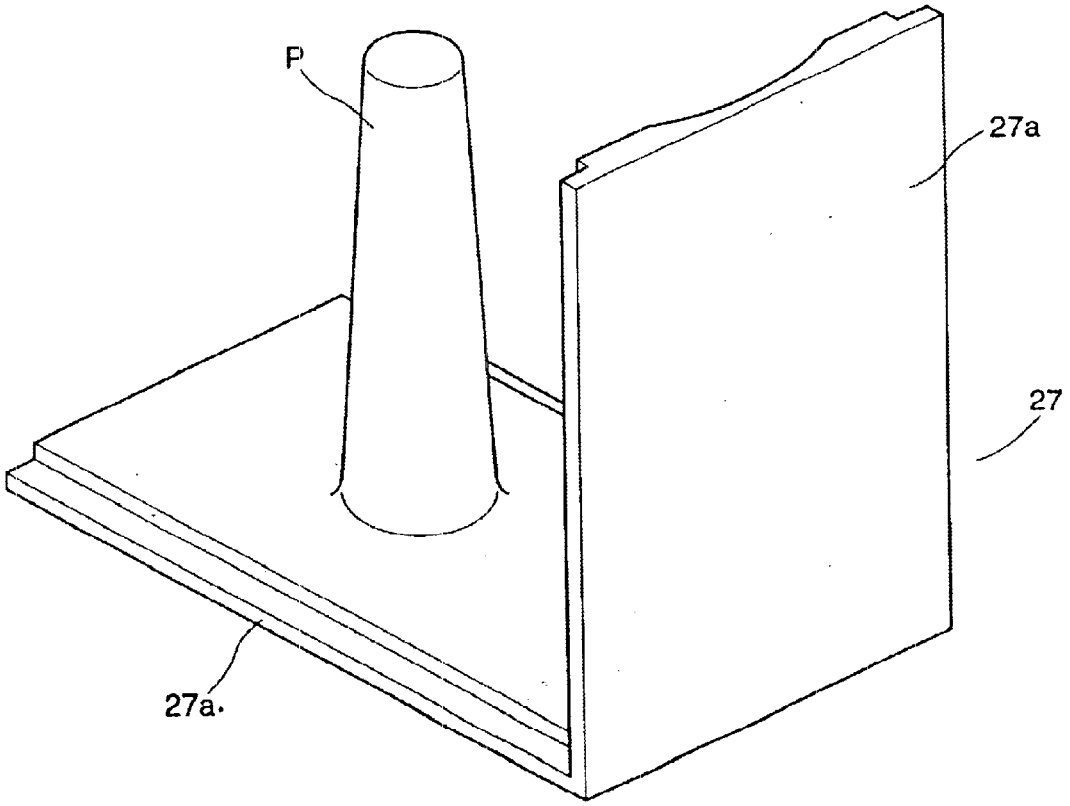
FIG. 7 is a perspective view of the corner bracket showing the details thereof and illustrated in the preferred embodiment of the invention.

Referring to FIG. 7 the substantially L shaped bracket (27) has first and second diverging legs (27*a*and 27*b*) extending at substantially right angles to one another, said bracket (27) includes an integral conical pivot pin (P) disposed on the leg (27*a*), said pin (P) for accommodating the roll out shower curtain assembly.

The frame (20) therefore may be located in a shower enclosure by affixing two sided tape to the outside of the frame locating it in position within the enclosure once the frame is fully assembled and then siliconing the frame to prevent water passage. The entire assembly therefore can be put together quickly without the need for screws, nuts, bolts or the like. It is not necessary that any holes be drilled as well.

Conveniently, the panel (35) can contain any advertising message such as "Les Freres Heureux" which may be readily replaced by replacing panel (35) conveniently by removing the ends (40) from slots (51 and 61) when the screen (30) is moved to its operative position and replacing it with a like panel (35') having another message for advertisement purposes.

Figure 8:
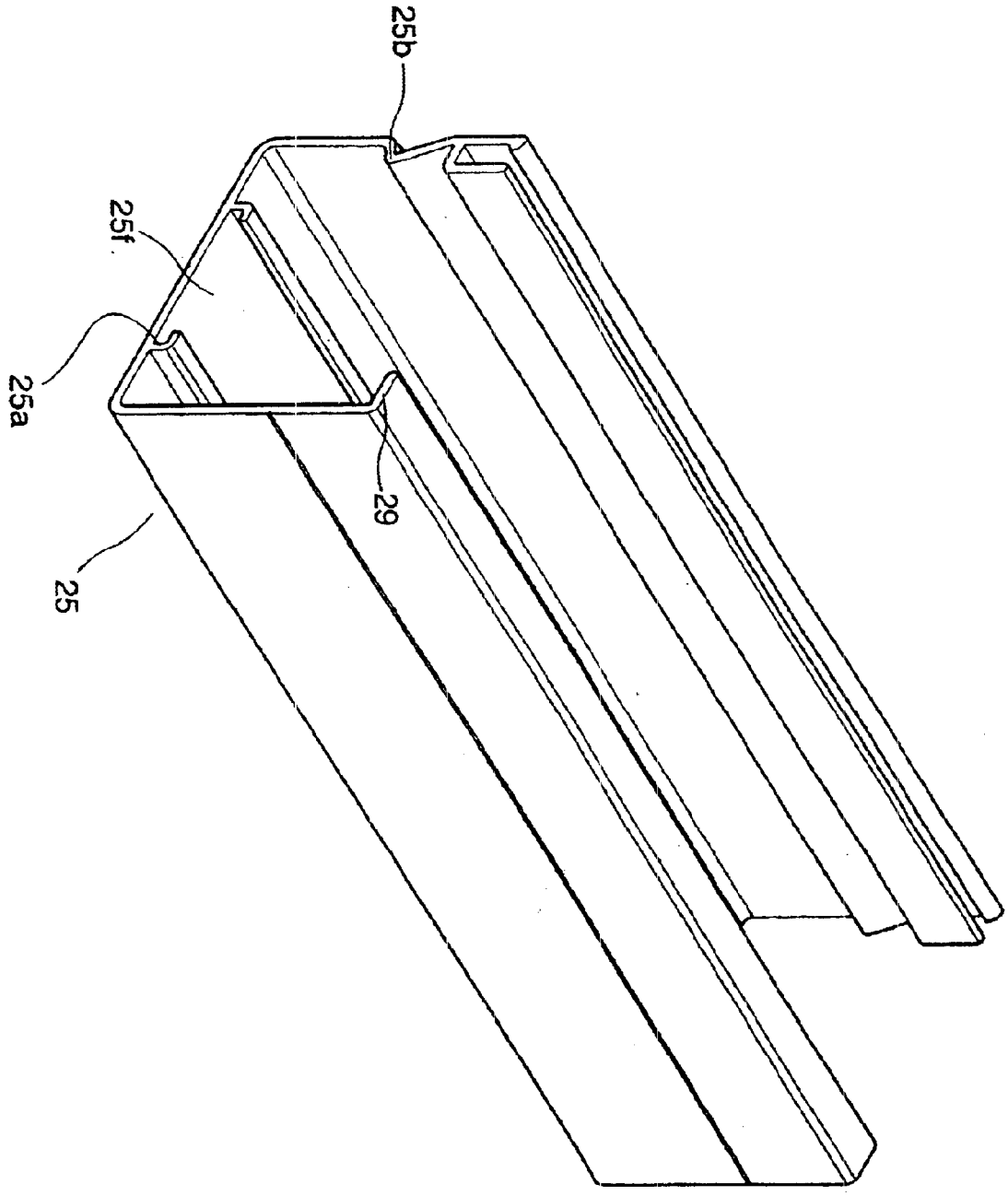
FIGS. 8 and 8A are perspective illustrations of a generally U-shaped section of the frame illustrated in one embodiment of the invention.
Figure 8A:
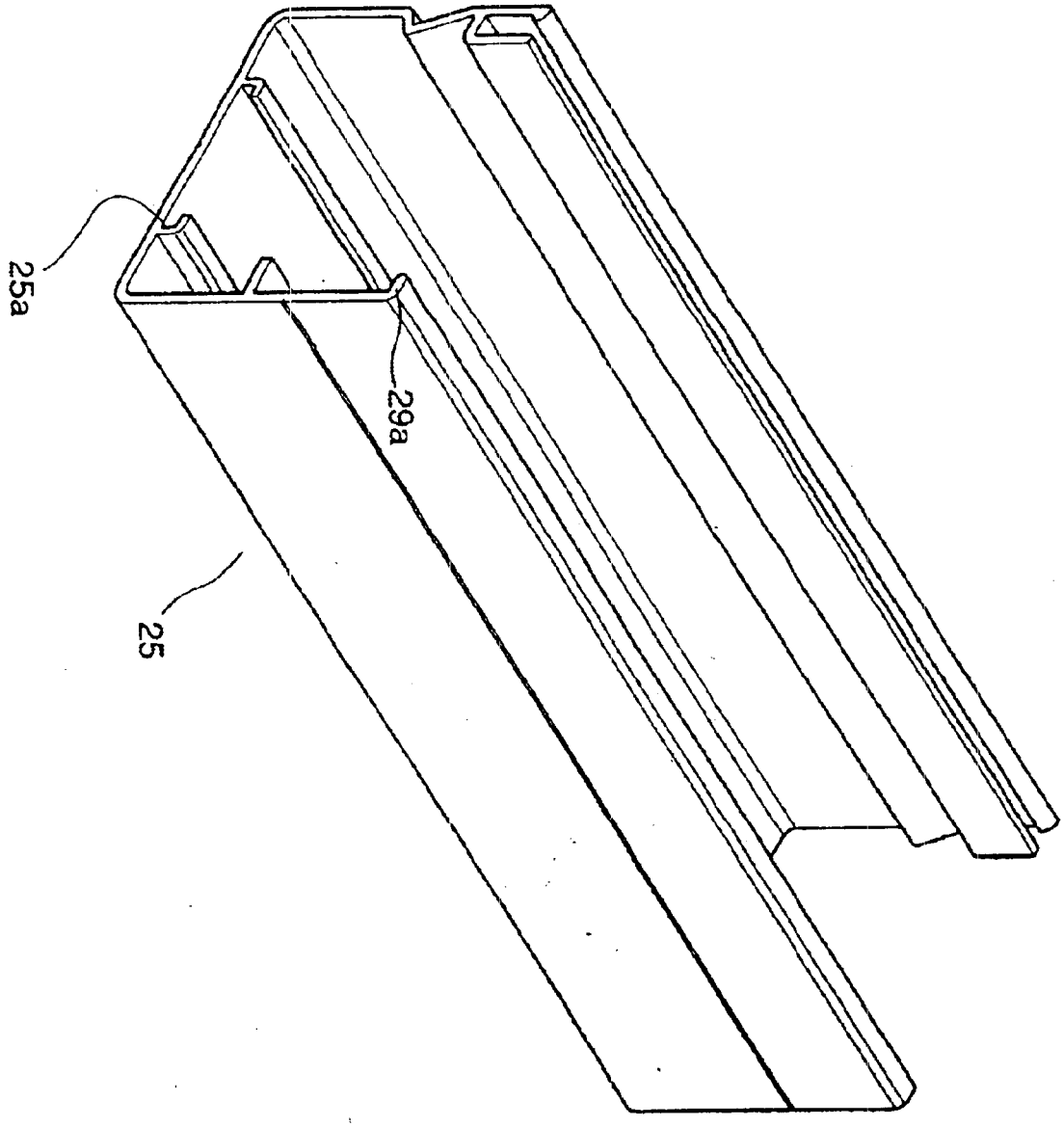
Figure 8B:
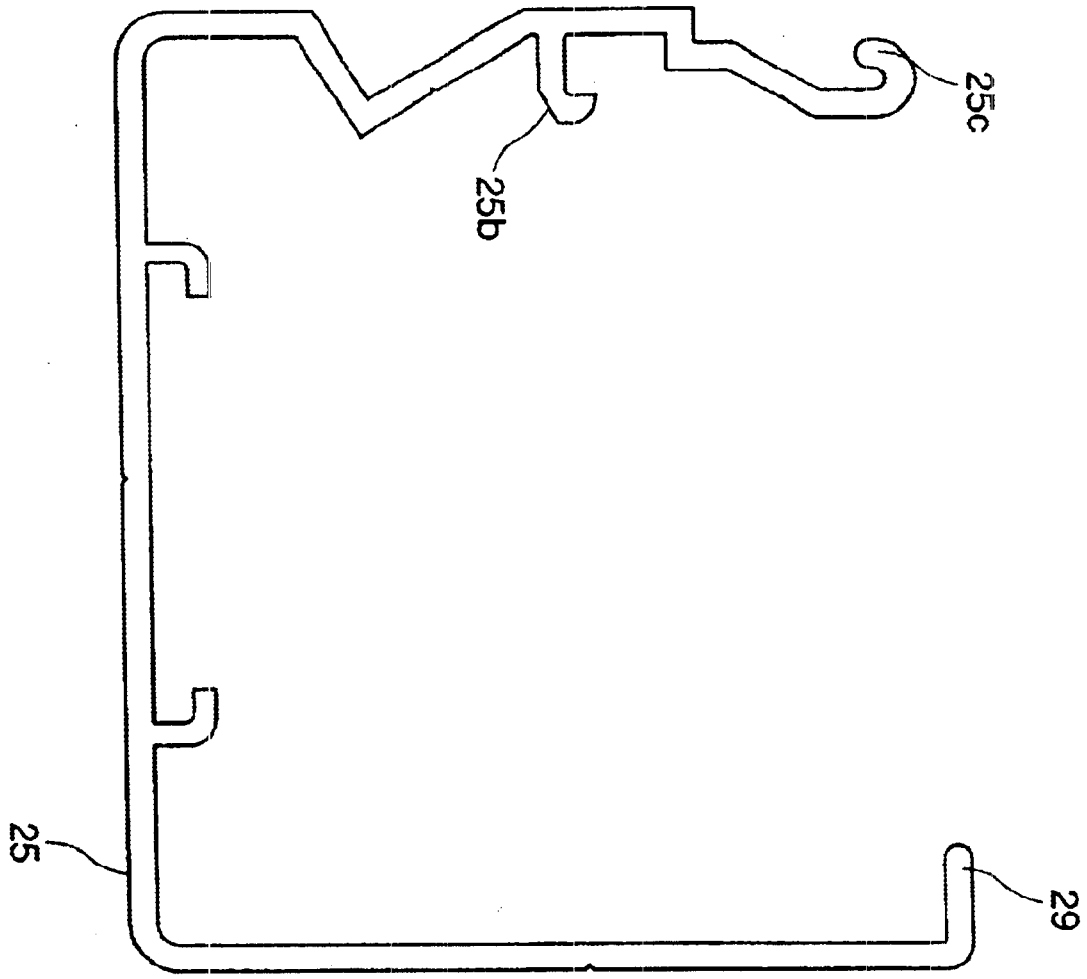
FIGS. 8B and 8C are cross-section illustrations of a generally U-shaped section of the frame illustrated in another embodiment of the invention.
Figure 8C:
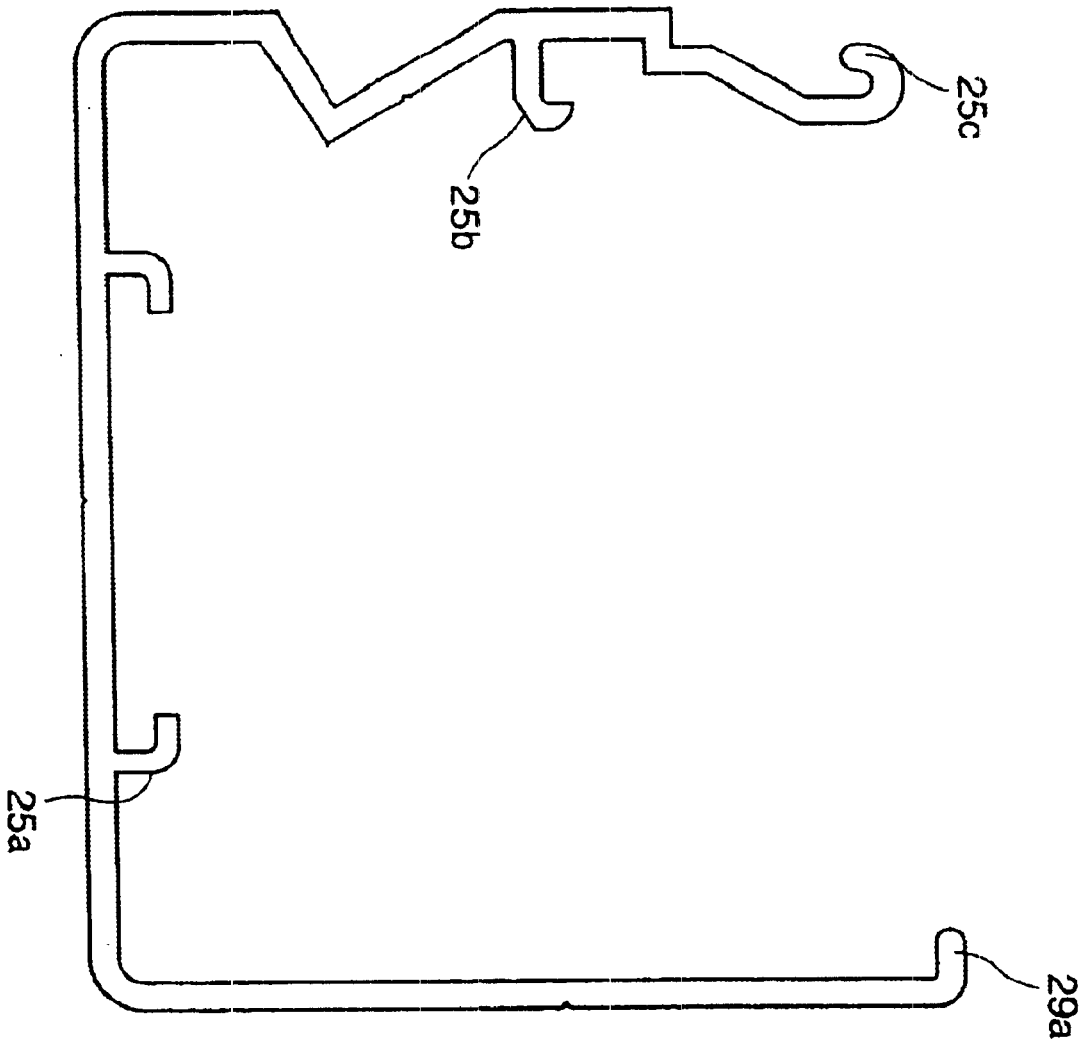
Figure 9:
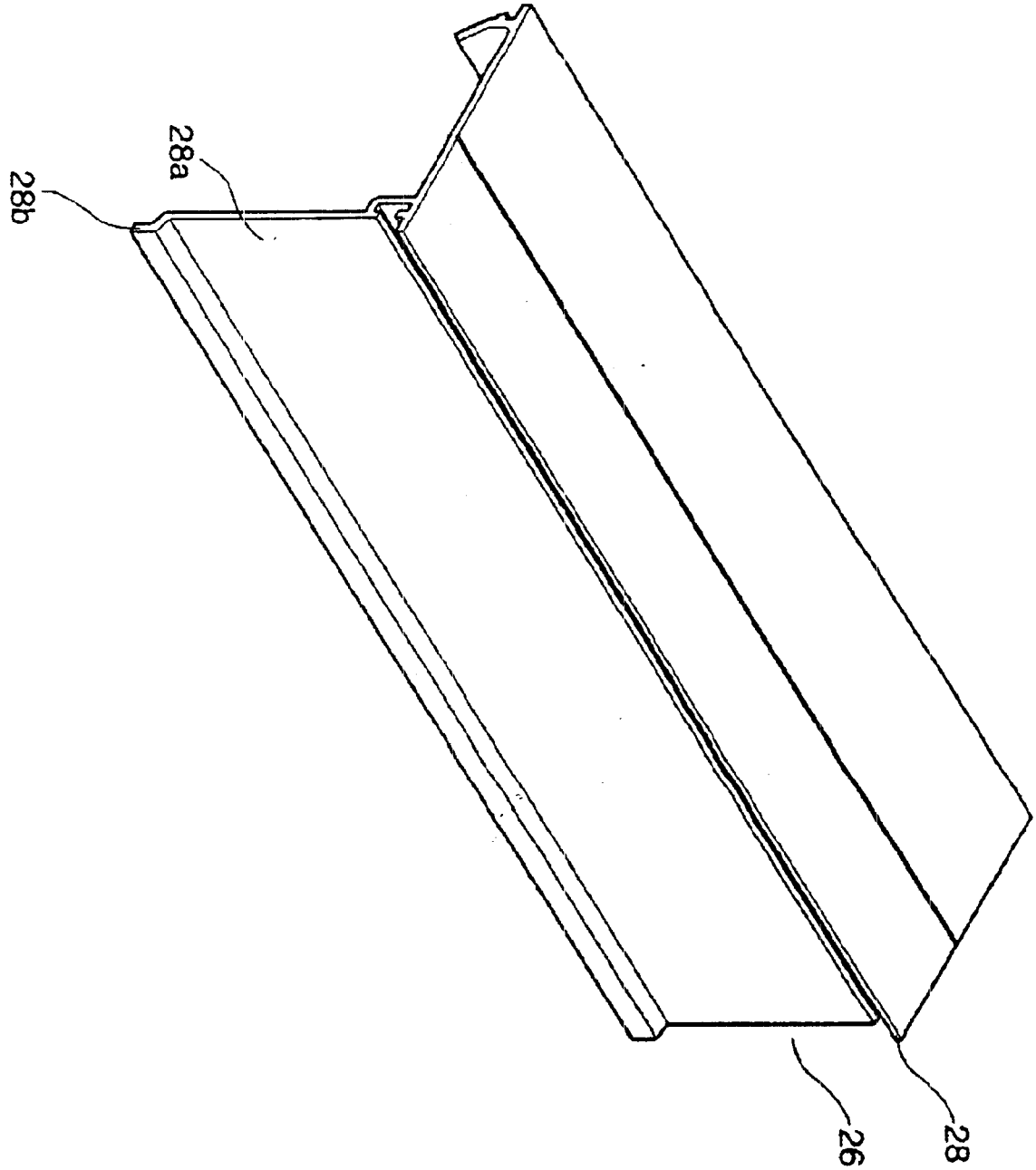
FIGS. 9 and 9A are perspective views of the caps sections to be utilized with the U-sections of FIGS. 8 and 8A.
Figure 9A:
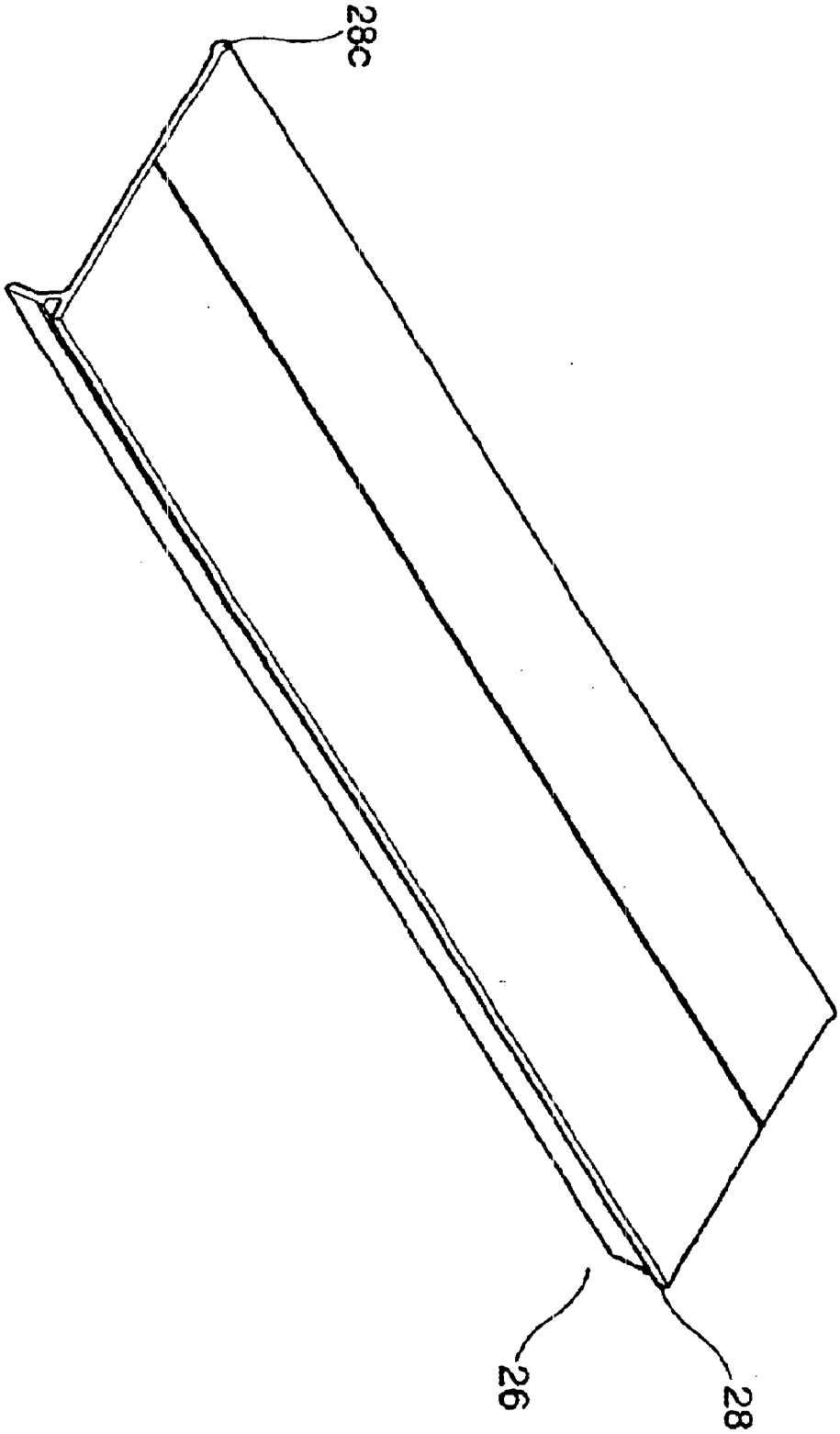
Figure 9B:
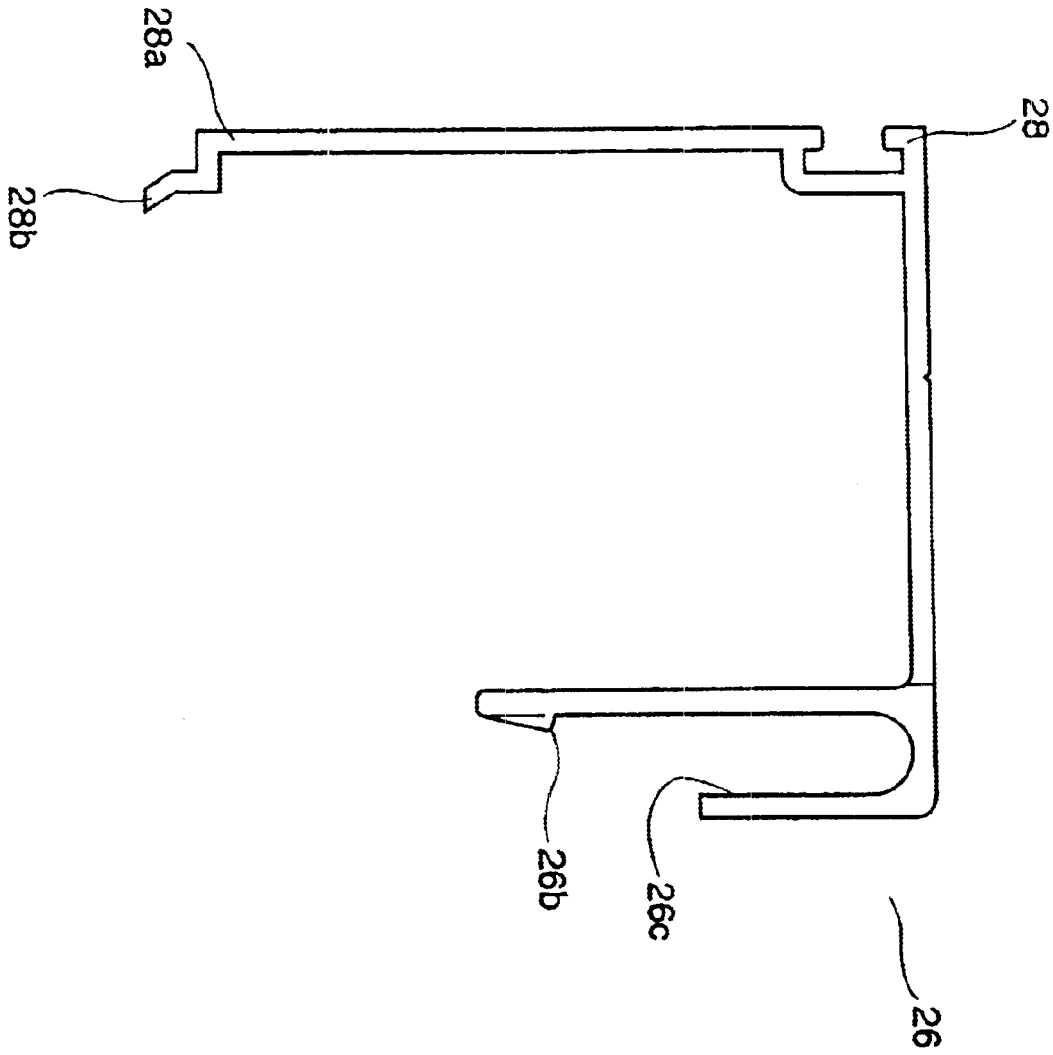
FIGS. 9B and 9C are cross-section illustrations of the cap sections to be utilized with the U-sections of FIGS. 8B and 8C.
Figure 9C:
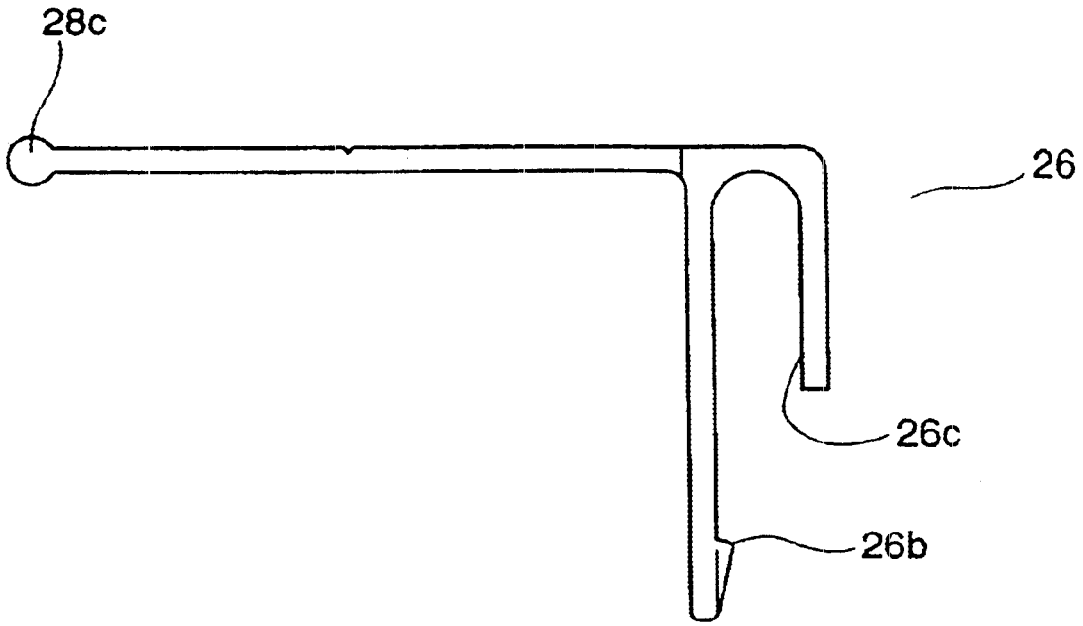
Figure 10:
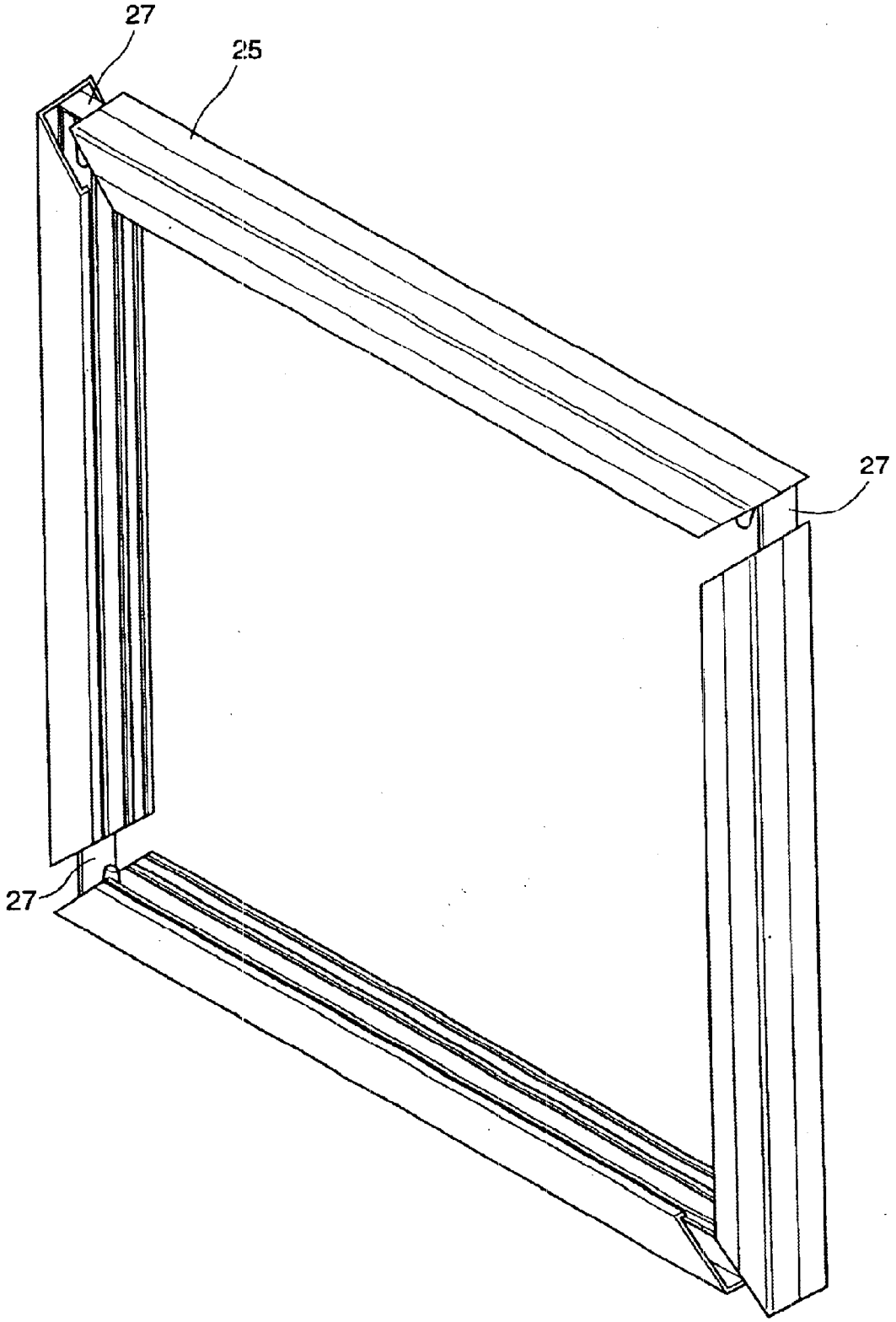
FIG. 10 is an exploded view illustrating the manner in which the U-shaped sections interfit using the bracket of FIG. 7 and illustrated in a preferred embodiment of the invention.
Figure 11:
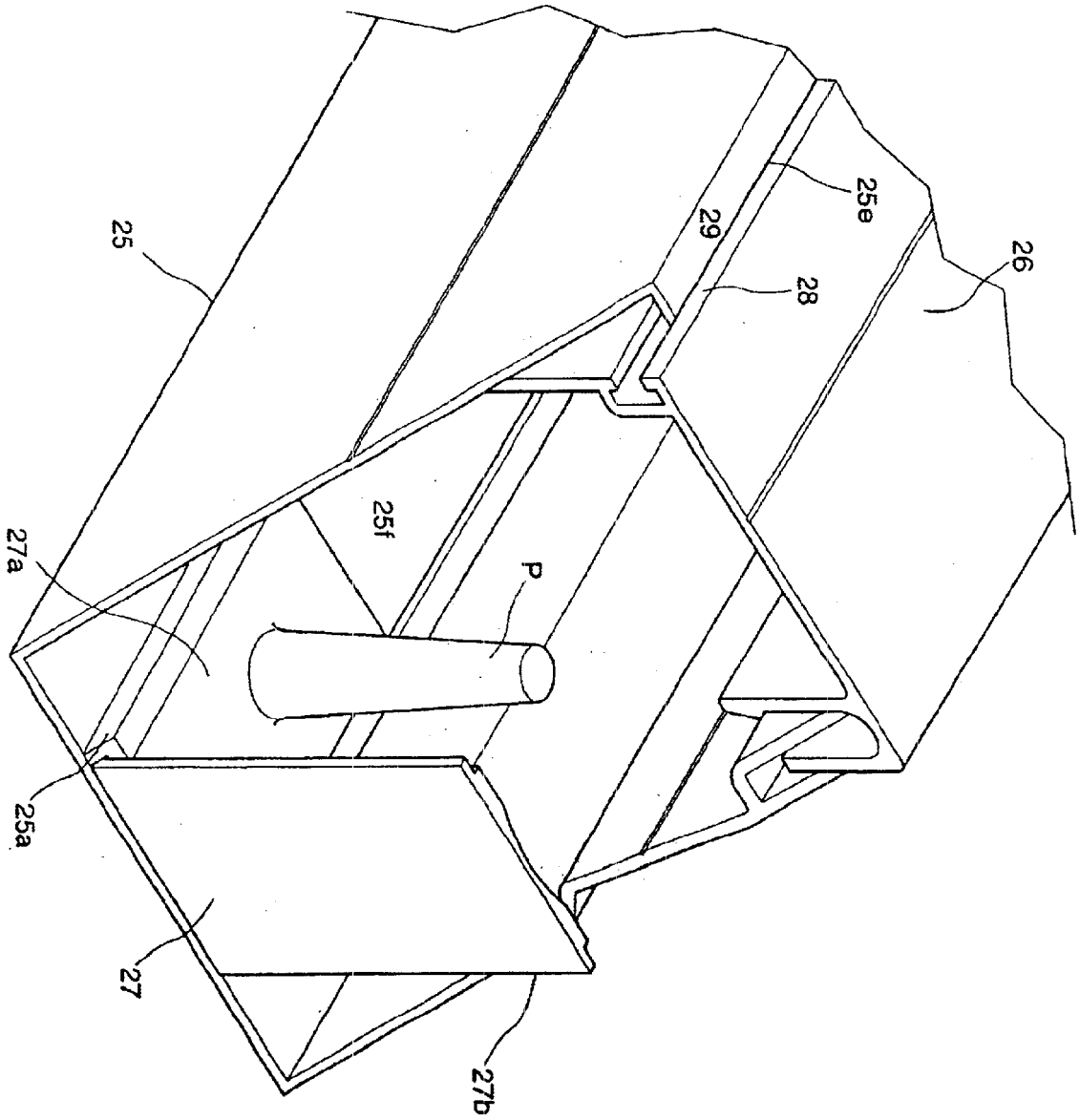
FIG. 11 is a perspective view of the corner bracket of FIG. 7 showing the manner in which the U sections inter-fit and illustrated in a preferred embodiment of the invention.

It is not mandatory that U section 25 and caps 26 be utilized. Closed sections would work well providing that one jamb section includes the ability to contain the curtain assembly 30. By way of example FIGS. 8 and 8A are not identical with FIGS. 8B and 8C which are described above. They inter-fit however using the same manner and are merely different variations of the same snap connection. The leg 26*b*of section 26 hooks or snap fits with the detent 25*b*of section 25. FIG. 9C illustrates the cap for the section 25 containing the assembly 30. The leg 28*a*is removed and replaced with a blunt end 28*c*. Normally leg 28*a*will engage the edge of rails 25*a*via abutment 25*b*. Portion 25*c*is captured in section 26*c*to secure the sections from lateral motion.

Although the preferred embodiment is the roll out screen assembly for use as advertising within a shower enclosure for the hospitality industry, it is not considered to be the only structure as previously discussed. However, because it provides a planar surface where the image, message or advertisement can be displayed on a flat surface on both sides of the curtain visible both when the occupant takes a shower and otherwise, it may be found to be the most preferred structure when compared to the alternatives but this is has yet to be tested.

Figure 5:
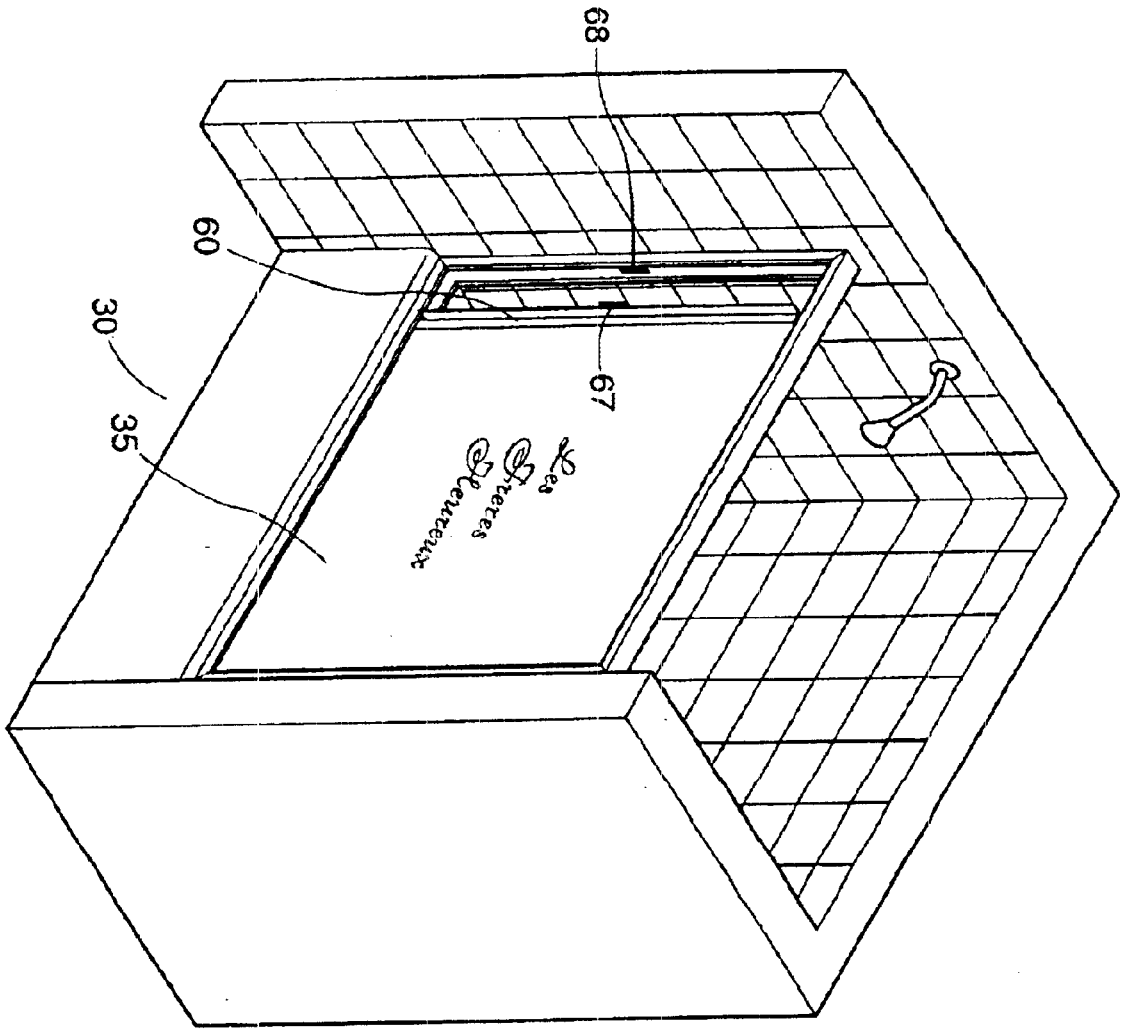
FIG. 5 is a similar view to that of FIG. 4 illustrating the curtain moving to the operative position.
Figure 6:
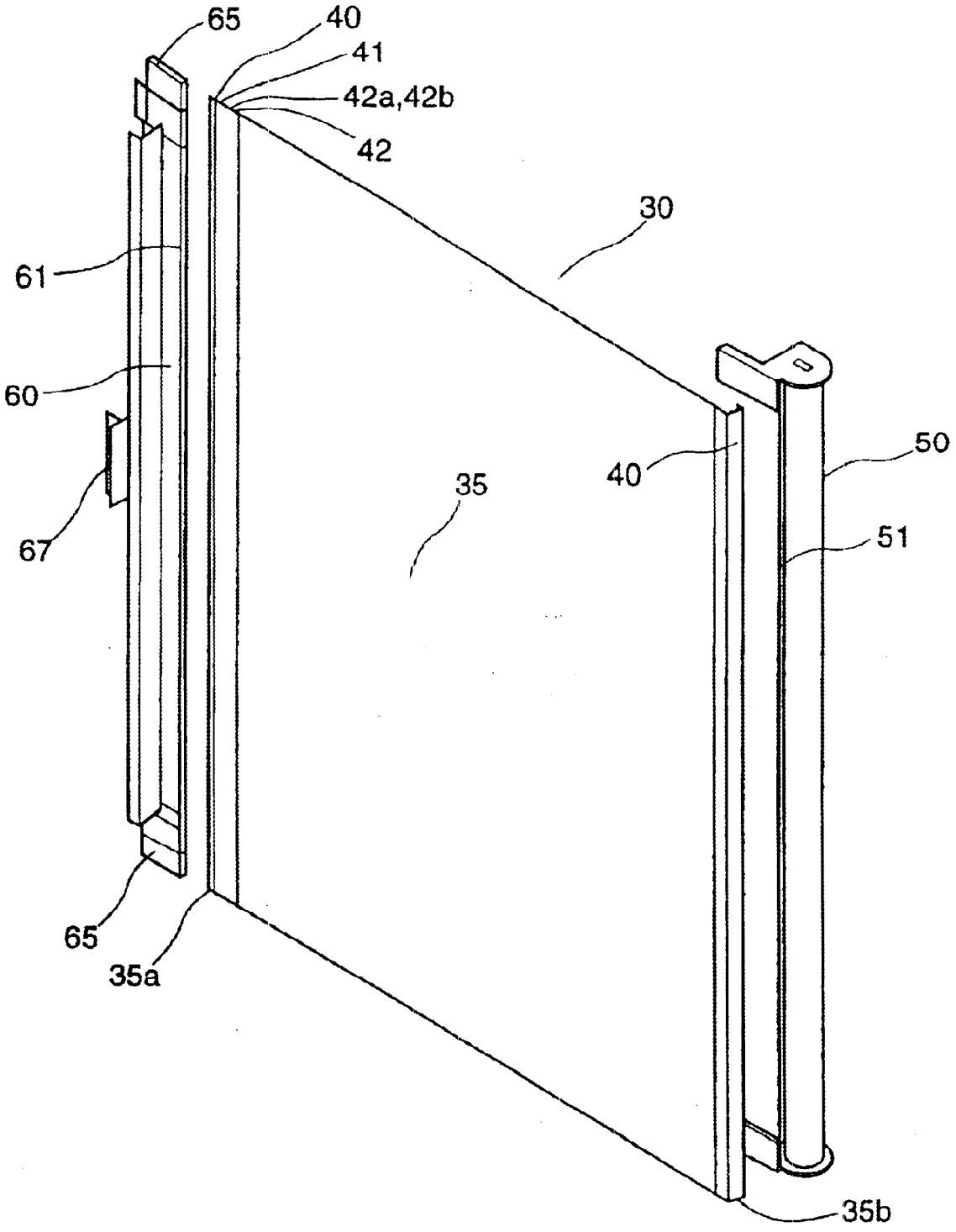
FIG. 6 is a preferred embodiment of the shower curtain contained on a roll tube.
Figure 12:
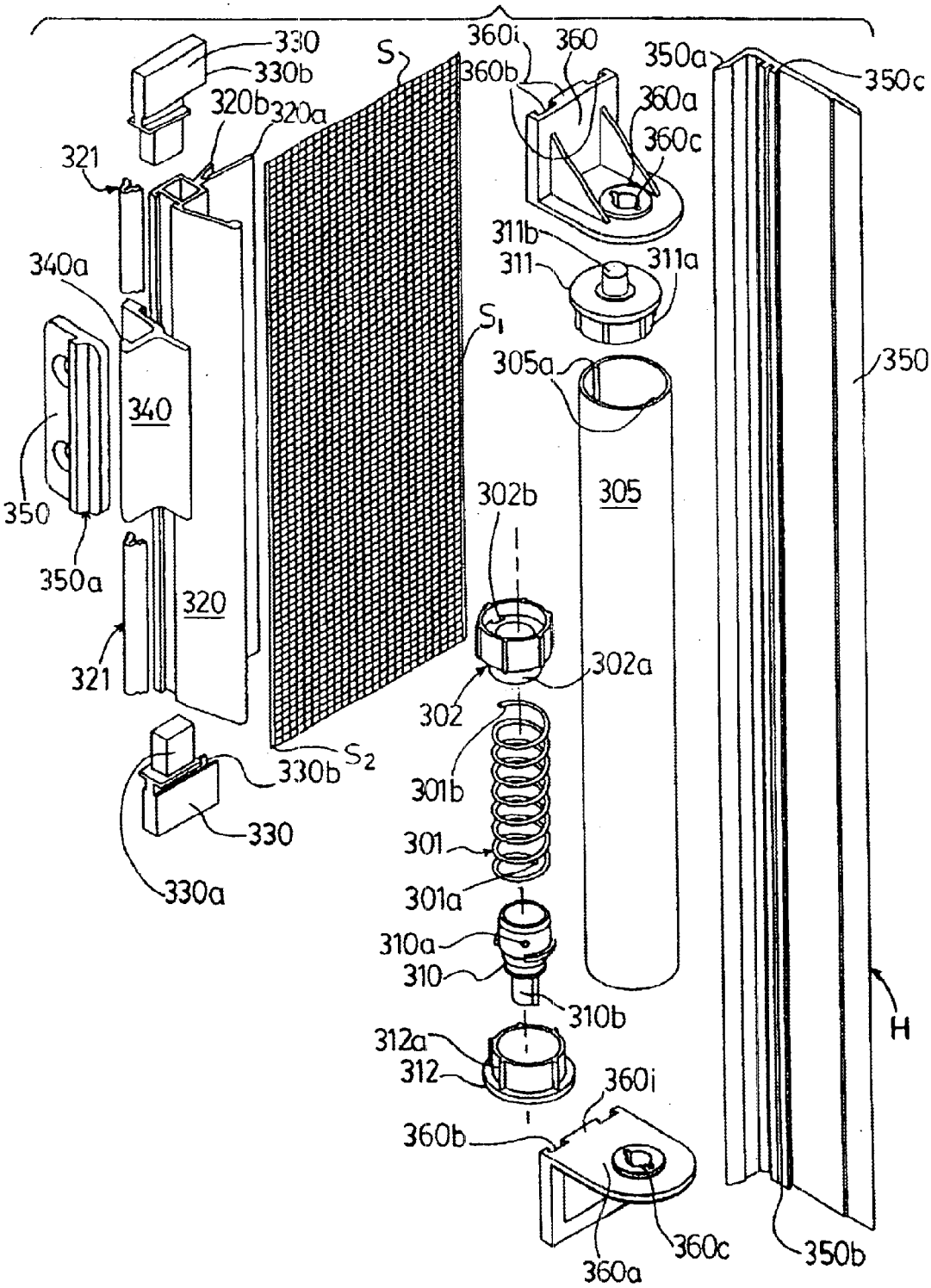
FIG. 12 is an exploded perspective view of a retractable screen assembly illustrated from the parent application.

From our prior co-pending application above-mentioned referring now to FIG. 12, there is illustrated a cassette assembly for a retractable screen similar to that of FIG. 5. The glides 330 at the end of the handle portion 320 telescope to accept manufacturing installation variations prior to fitting them into the guide rails. This glide feature also finds use with the present invention for a roll-out shower curtain.

Figure 13:
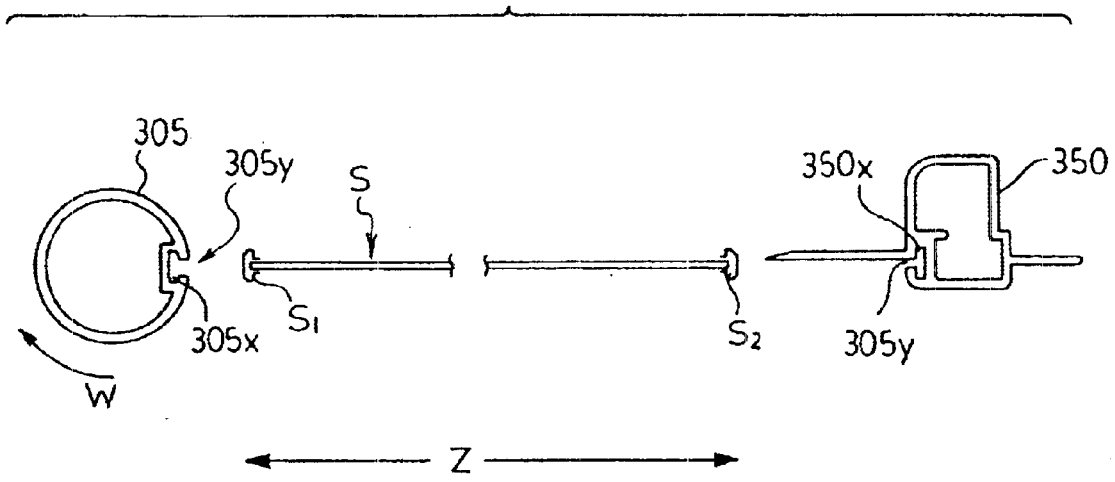
FIG. 13 is a schematic view of the installation of a screen of FIG. 12 in a retractable screen assembly and illustrated from the parent application.
Figure 14A:
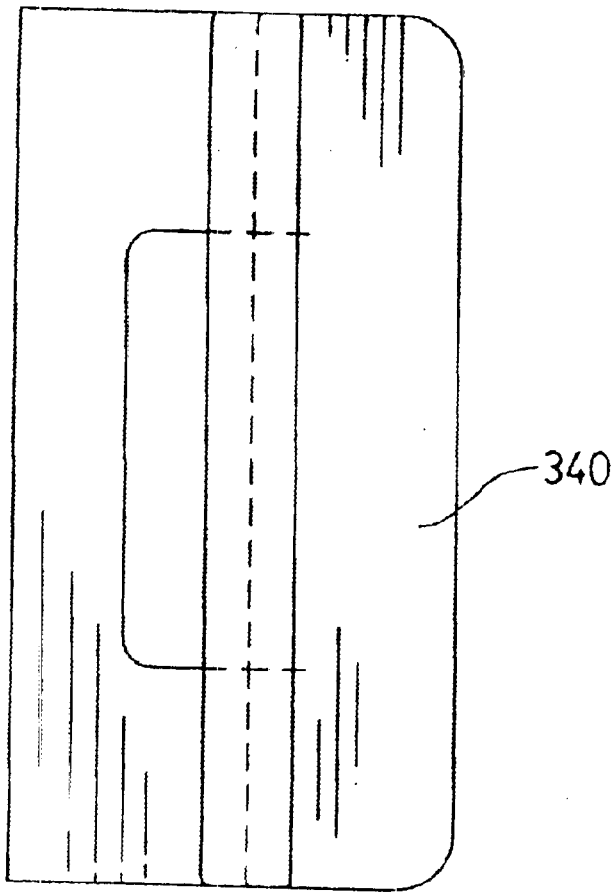
FIGS. 14A and 14B are top and side views of the screen lock illustrated in FIG. 12 and shown here in a preferred embodiment of the invention.
Figure 14B:
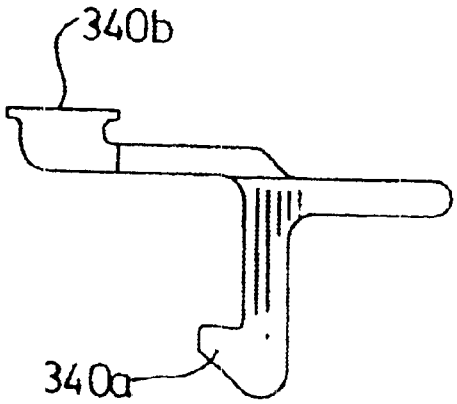
Figure 15A:
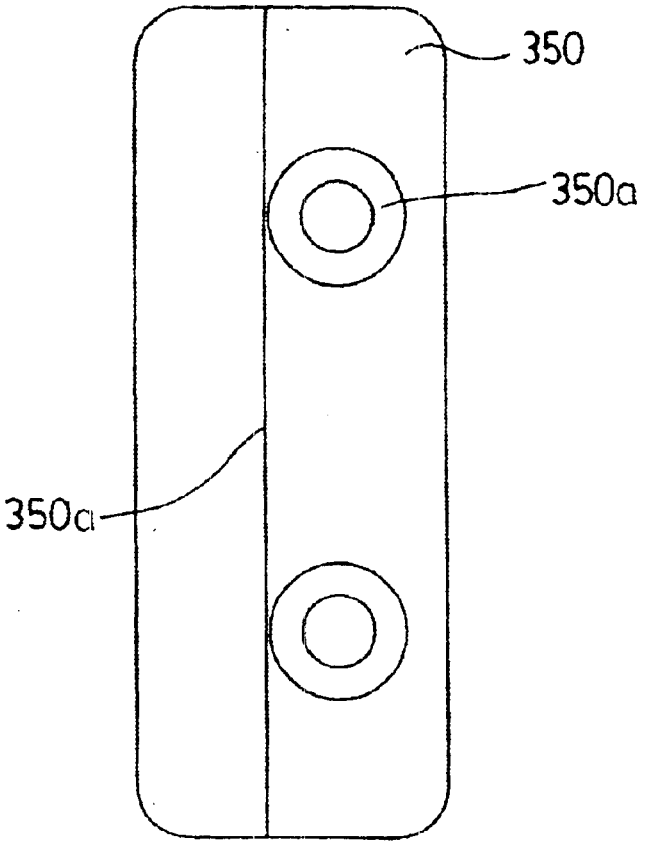
FIGS. 15A and 15B are top and side views of the latching plate of FIG. 12 and shown here in a preferred embodiment of the invention.
Figure 15B:
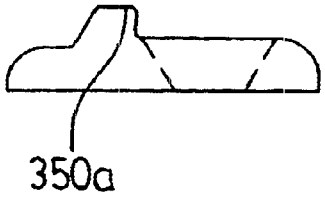

Referring now to FIG. 13, the screen embodiments shown in FIG. 12 may be utilized with a screen assembly which include generally T-shaped key portions S1 and S2 which are generally T-shaped and which engage with generally T-shaped openings 305*x*and 350*x*within the tube 305 and within the handle 350 in one embodiment of the invention thereof. By providing such a keyed relationship between the handle and the screen, screen replacement becomes very easy eliminating the need for adhesives and the general cutting of screen sections. The screen width indicated as Z therefore is a constant for all screens. Therefore, one continuous screen may be manufactured having the keyed portions located and anchored to the ends thereof as one continuous roll of screen having a predetermined size or width Z which may be cut to the desired length as the only variable dimension when making the assemblies of FIGS. 5 and 12 and/or replacing the broken screen/curtain which might result under normal wear. This keyed section and the provision of a quick panel replacement thereby finds application also for the edges of shower curtains, panels or blinds.

Referring now to FIGS. 12, and 14*a*, 14*b*, 15*a*and 15*b*, there is illustrated the latching portions of the screen assembly comprising items 340 and 350. The portion 340 is mounted on the handle portion 320 and is clipped in position via a hook portion 340*b*to be retained within a slot 320*i*and 340 as best seen in FIG. 12. This latching portion engages the latching plate of FIGS. 15A and 15B which is mounted via mounting openings 350*b*of the latching plate 350. The opposite jamb is utilized to mount the latching plate 350 so that as the screen moves across the opening framed by the frame assembly, the detent or latch portion 340*a*engages the latch portion 350*a*of the latching plate to retain the screen in its operative position. This can be released of course by disengaging the latching portions 340*a*and 350*a*respectively wherein the screen may be retracted within the opening in the jamb 10 of the framing section. Again this latch system finds application in our shower curtain.

Figure 16:
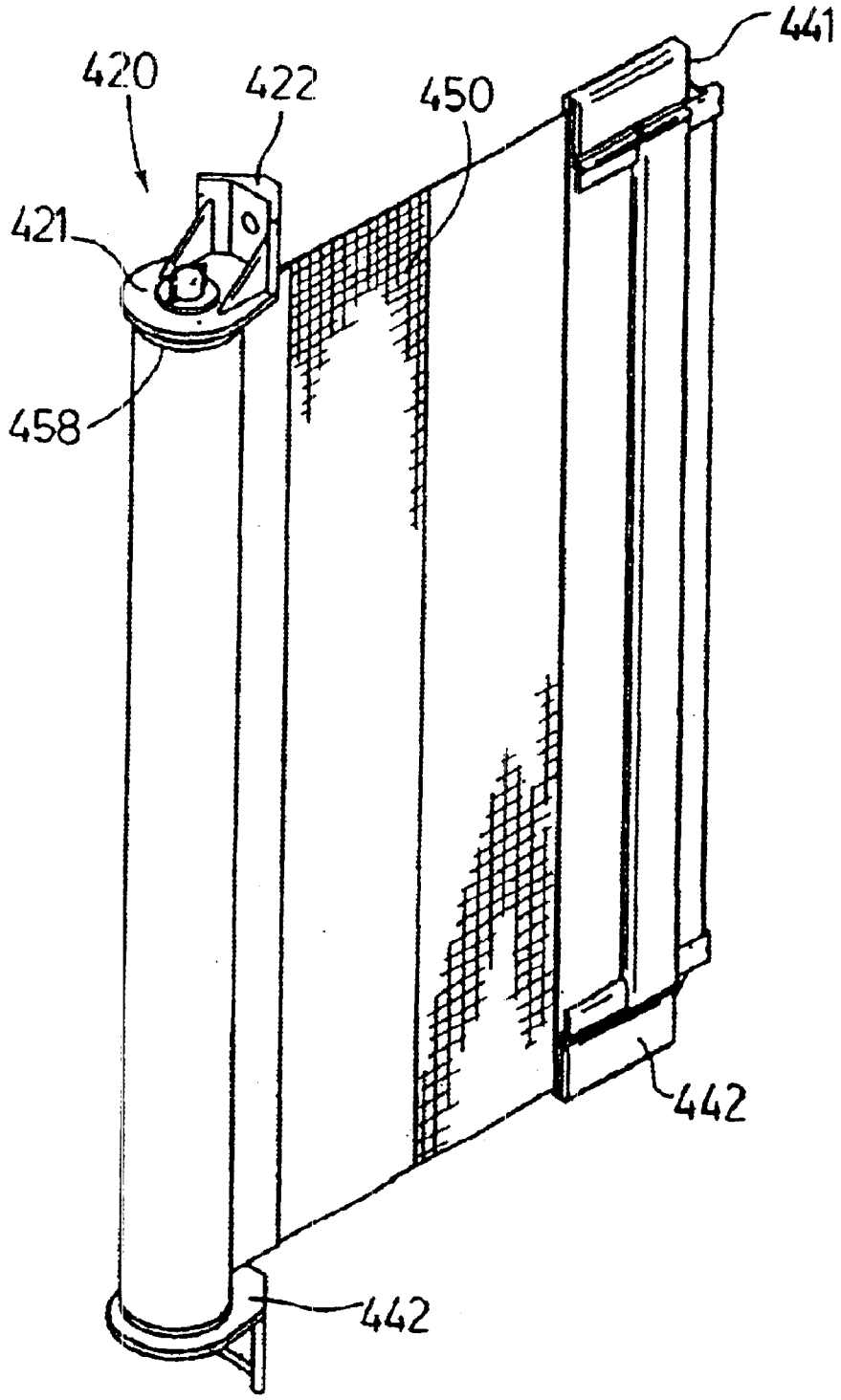
FIG. 16 is a perspective view of the screen assembly shown in the parent application.
Figure 20:
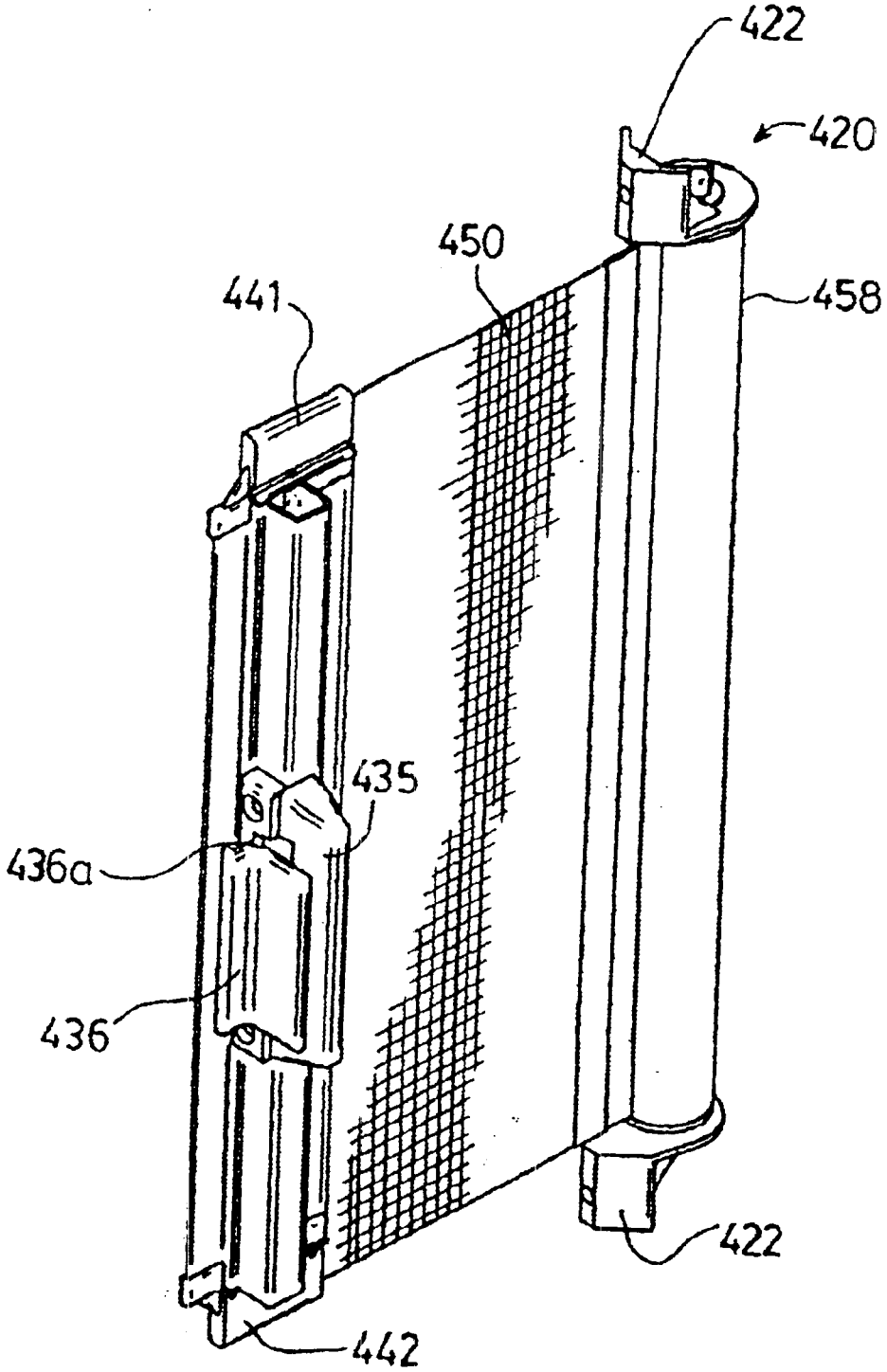
FIG. 20 is a schematic perspective view of the screen cassette assembly illustrated in a preferred embodiment of the invention.

As seen in FIGS. 16 and 20 the screen assembly 420 is contained within an opening or pocket provided in a framing jamb portion. The screen will therefore pay out along the pathway 413 when the handle portion 430 is moved along with the sash 405 when desired. A latch portion and handle portion 435 and 436 respectively including a hook portion 436*a*engages with a detent portion 406 at the hook portion 406*a*. The movement therefore of the sash will result in the movement of the screen 420 automatically and pay it out through the guide recess to cover as much of the opening as is desired. That is to say that one may pay out the screen 10% or 100% to cover the appropriate opening. The glide assembly therefore will accommodate and receive the upper edges and the bottom edges of the generally T-shaped screen portion as best seen and described in relation to FIG. 12. An upper glide 441 therefore and a lower glide 442 is provided to ride within the respective channel portions of the jamb framing sections. The handle portion 430 therefore is adapted to receive the leg portions 441*a*and 442*a*of the glide portions respectively. A bug block 440*c*is provided as is previously described. The screen therefore will pay out from its roller as best seen in FIGS. 16 and 20 including the glides capturing the edge of the screen including the generally T-shaped portion and riding within the guides of a tilt and slide window assembly. When it is desired not to operate the screen, the latch 436 is operated to separate the detents 436*a*and 406*a*. The window will then operate on its own without the screen. Should it be desired to recapture the screen, one merely closes the window and snap locks the two detents together again to re-engage the screen assembly.

Figure 17:
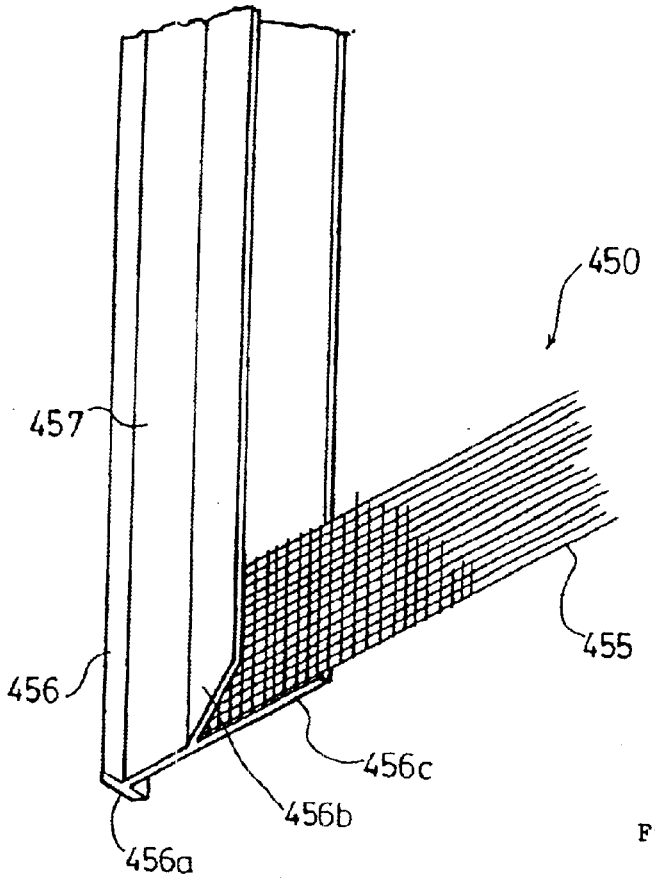
FIGS. 17 through 19 are partial perspective cut-away views of the screen assembly including the T-shaped portion and the method of assembling it with the screen and illustrated in preferred embodiments of the invention.
Figure 18:
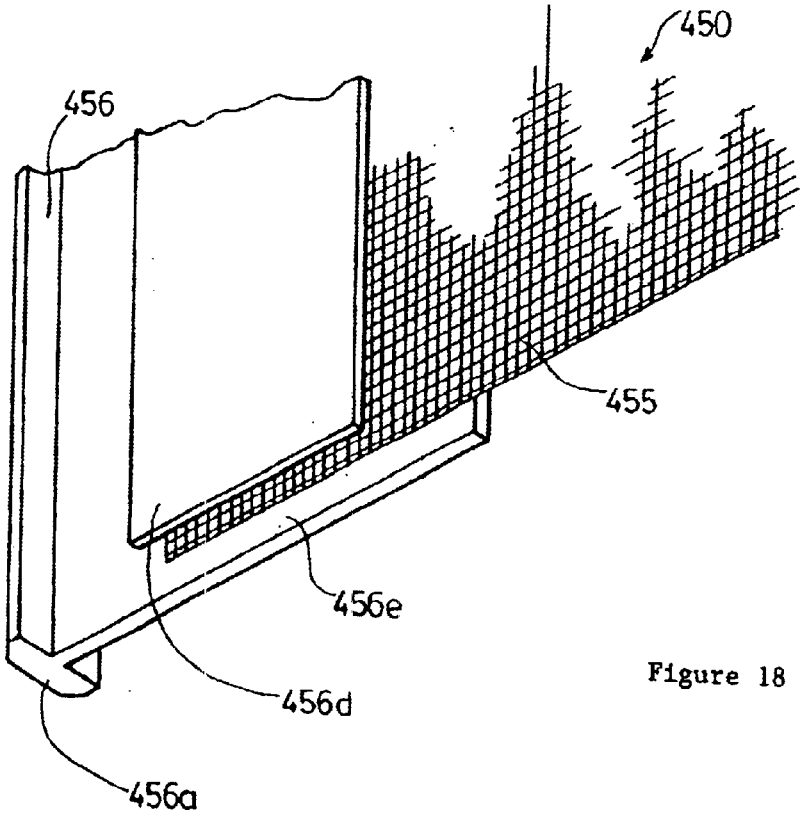
Figure 19:
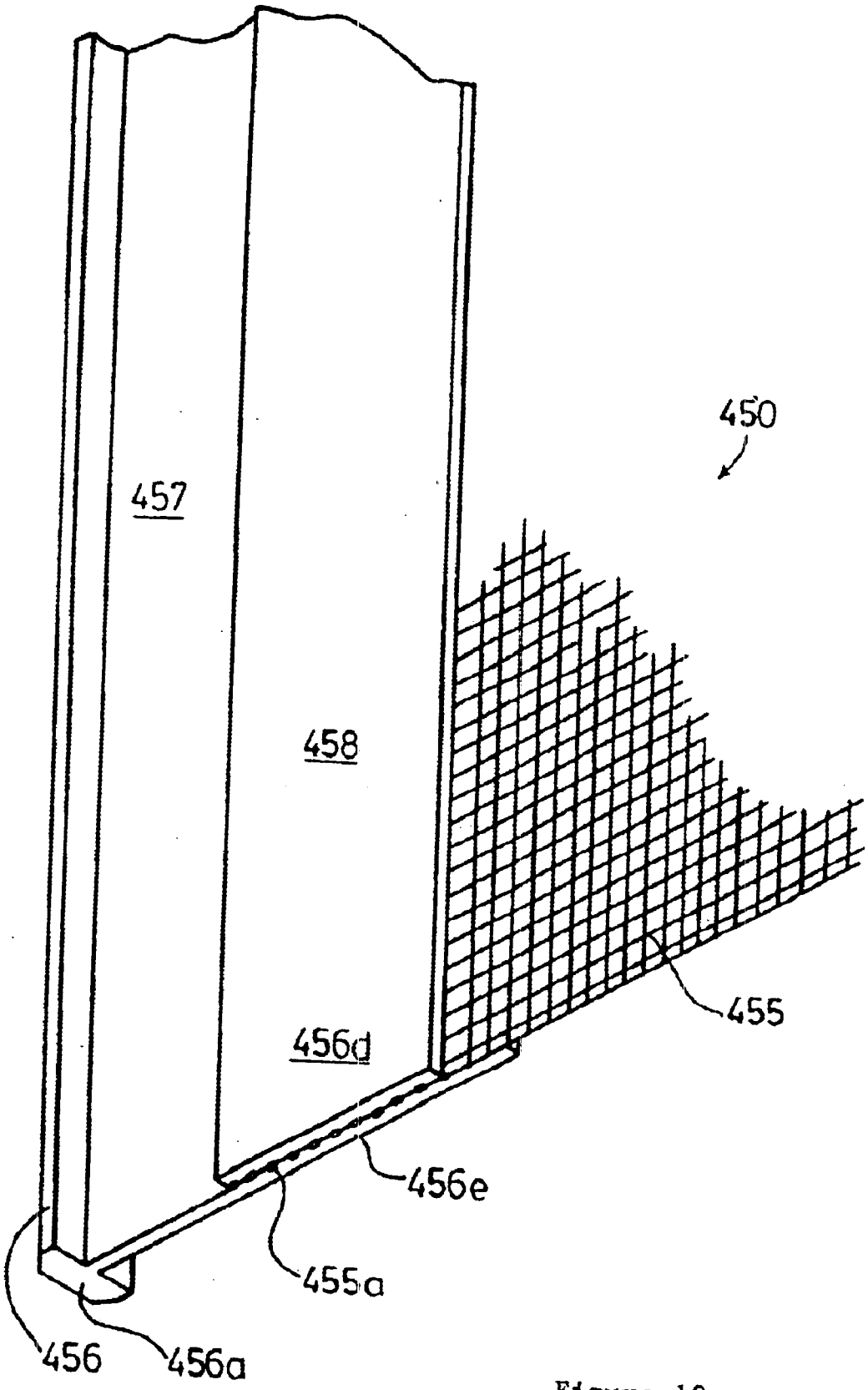

Referring now to FIGS. 17 through 19, there is illustrated the method of assembling the screen with the generally T-shaped key portions. The key portions 456 therefore are manufactured from polyvinyl chloride or the like which is a material that may be radio frequency welded. The key portions therefore 446 include the head portion 456*a*for capturing within the appropriate groove of the handle and roller portion. The head portion therefore is separated from the two portions 456*b*and 456*c*, or alternatively 456*d*and 456*e*making up the leg to capture the screen 455 or sandwich it therebetween. In FIG. 17, the two legs 456*b*and 456*c*are generally connected to one another and separated from the head portion 456*a*by a flexible extension 457 which is not radio-frequency welded to the screen 455. This section 457 provides a considerable amount of flexing for the screen assembly and reduction in damage to the screen 455 as a result of any tensioning load on said screen 455. Once the two screen-capturing portions 456*b*, 456*c*, or alternatively 456*d*and 456*e*, as seen in FIGS. 17 and 18 respectively, capture the screen 455, the screen is passed through a radio-frequency welding machine continuously preferably so as to form a continuous roll of screen accumulated on a roll for future use. As best seen in FIG. 19, elements 450*a*of this screen which is manufactured from vinyl-coated fiberglass are melded into the polyvinyl chloride of the leg extensions 456*d*and 456*e*of the key element. In this manner, a tough and viable screen assembly is provided.

Referring generally to the figures a method of manufacturing a screen roller assembly comprises the following steps:

1) forming a screen from suitable screen material such as fiberglass and preferably coating said screen with vinyl,
2) forming a generally key-shaped anchor for said screen preferably from polyvinyl chloride, preferably said key having a head and a leg comprising two portions and a connector connecting said leg to said head, preferably said head being generally T-shaped,
3) separating the two leg portions for receiving the edges of said screen,
4) radio frequency welding said leg portions capturing said edges of said screen and preferably melding said vinyl of said screen with the PVC of said key,
5) forming a continuous screen to be accumulated on a roll as roll stock to be supplied to the window manufacturer or repair organization, A predetermined amount of screen may be payed of the roll stock roll sized to a predetermined window opening size which may be easily assembled with the spring-biased roller upon which the screen will accumulate by a manufacturer or by a repair person and which also may be engaged with the handle portion proximate the other edge of said screen, both said roller and said screen handle including a compatibly shaped generally key-shaped receiving portion to receive the head of said key for easy installation or replacement thereof.

It is important that the legs of the key portion be separated from the head portion by a flexible extension to allow for the accommodation of stretching in the screen assembly at that particular location when assembled without destroying the screen. It has been found that the screen when melded together with the PVC key has considerably more strength than the known methods of taping and gluing screen edges to rollers and handle portions. The flexibility is provided by the flexible key shape and material. Any suitable material can be utilized including those materials which readily accept hot welding. However, radio frequency welding is preferred because one does not have to allow for creeping of the material and the allowances of temperature differentials. Cold dies may be provided which come together to provide a reliable joint which may be accurately controlled.

To produce a screen one cuts from roll stack the "T" edge screen 450 to fit inside the frame opening of the window allowing for the guiding track depth less any clearances required. The roller drum 458 and handle 430 are cut to screen length providing for clearance as required. The "T" edge of the cloth 456*a*is slid into the drum slot 458*a*and the other "T" end 456*a*being slid into the handle slot 430*a*thereby fixing the screen to the critical components. A telescoping glide with its own "T" slot groove as previously described supports the screen in the guide track at each end thereof and allows the glide the freedom to move back and forth on the "T" edge of the screen taking up the opening tolerance.

Because the "T" edge is flexible and able to stretch, any local load on the screen cloth will distribute itself over a wide range of fibers of the screen thus improving the impact and tear resistance of the system. In the event that screen was pushed it would pay out the stored material to the end limit reducing dramatically the stress forces on the system. With the high tensile capability of the "T" edge system, the risk of failure of the system is greatly reduced. In servicing a screen that is already installed on site, a bolt of screen cloth carried by the service person need only be cut to the right length, the cover removed from the system to give access, the old screen cloth slide out and the new screen cloth rethreaded. There is no need for any other component replacement if they are sound.

The screen is self storing within the frame of the window by virtue of accumulating on a roller similar to the operation of a roller blind. It is payed out by pulling on a full length handle which is guided by a rail at each end. The window frame includes a guide channel for the screen which tracks and covers the free edges of the screen. The handle provided with the screen engages the adjacent sash frame section with latch detents provided which will maintain the screen under tension from the dispensing drum and covers the opening created when the sash is opened by sliding in the track wrinkle free and bug tight.

Figure 21:
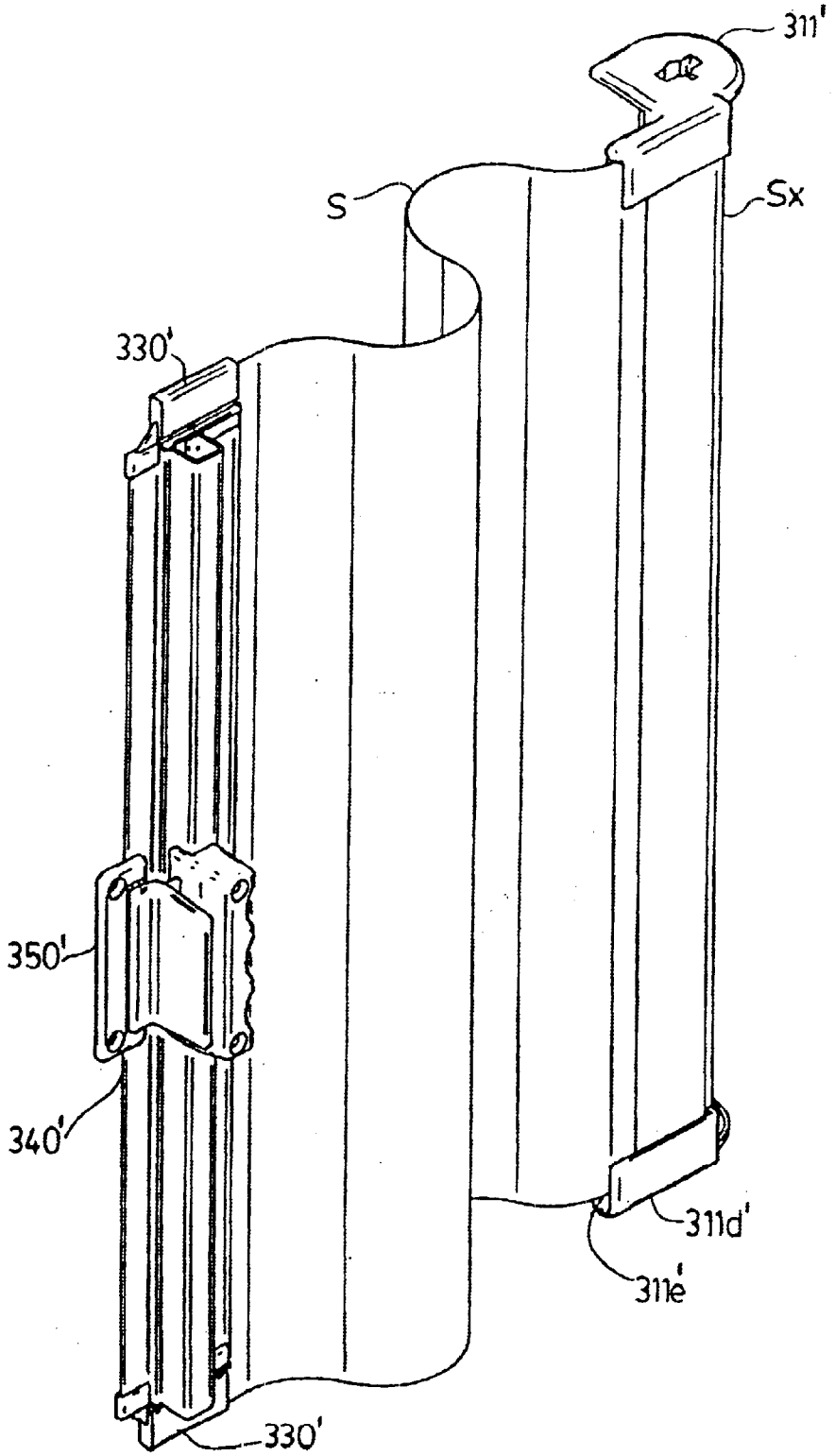
FIG. 21 is a perspective view of the roll screen cassette isolated from the frame section.
Figure 22:
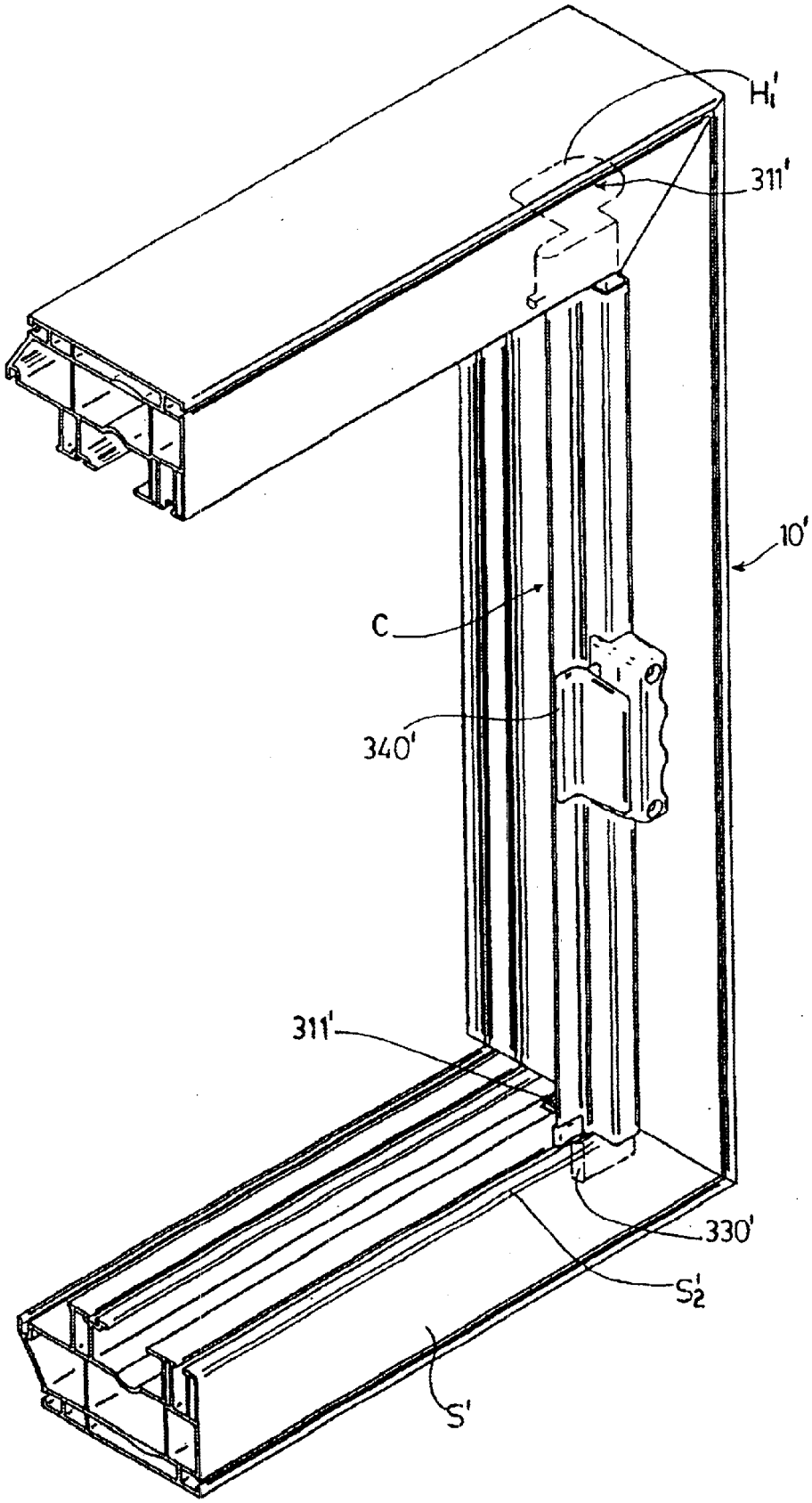
FIGS. 22 and 23 illustrate in a preferred embodiment of the invention the roll screen cassette being installed in a window frame.
Figure 23:
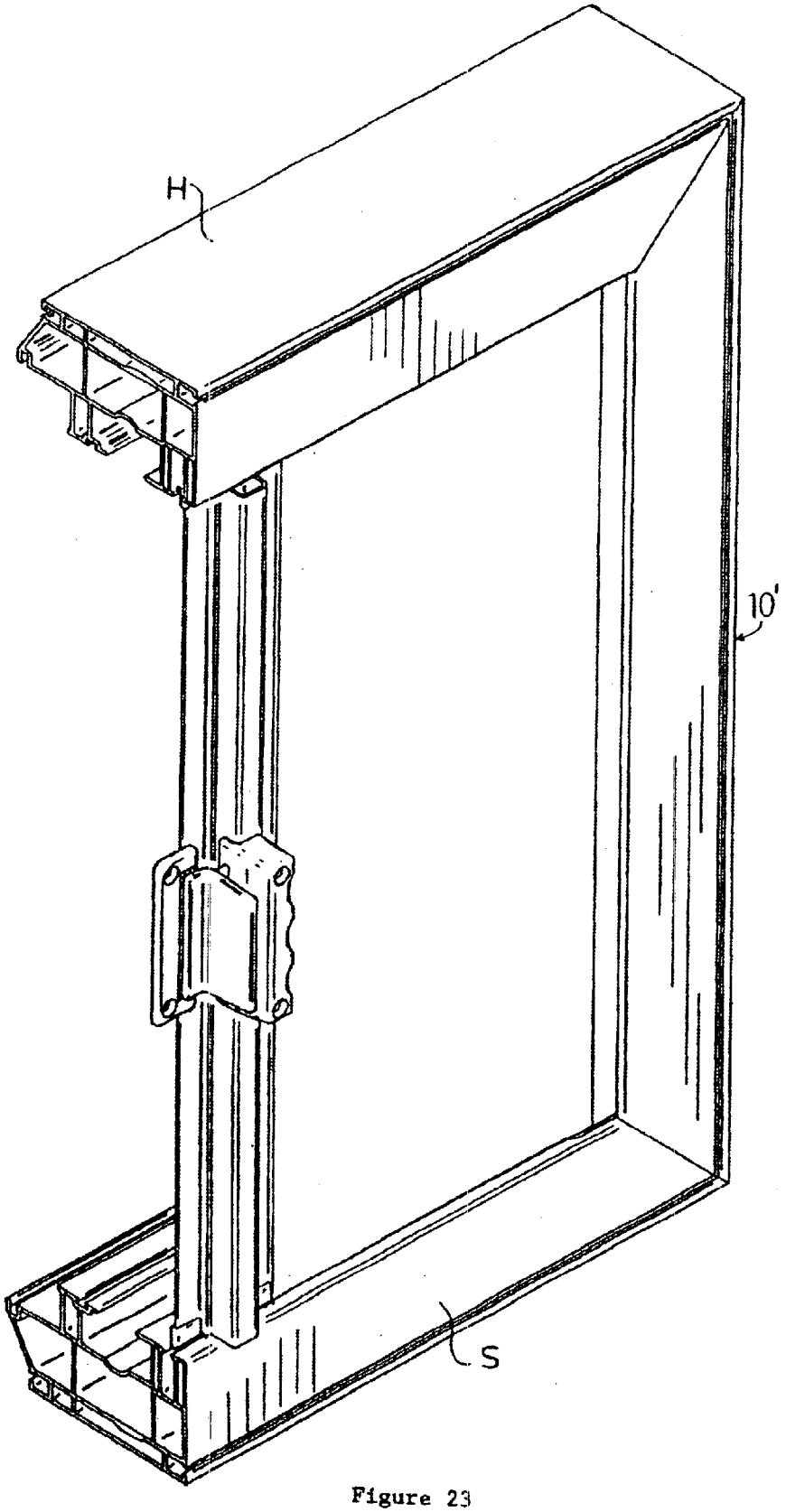

Referring now to FIG. 21 and particularly in relation to FIGS. 22 and 23, the screen cassette is assembled in a complete form upon the brackets 311' having glides 330' provided therewith for installation within the jamb section 10' having the pocket P'. FIG. 23 illustrates the window assembly and the screen cassette without ghost lines to illustrate the esthetic appearance of the entire assembly. Standard framing sections for the header, sill and jambs may be provided in order to simplify the construction of the window and improve its appearance.

The above-mentioned teachings in relation to roll out screen assemblies is taken from our co-pending prior applications the contents of which equally applies to shower curtains, blinds and other panels. In every instance where screens are referred to the reader will understand that the terms curtain, panel, or blind will equally apply. The details of a roll out panel system whether a shower curtain, or window blind or the like would be substantially similar or even identical. For example the T edge of the screen which is radio frequency welded to the screen would also apply for a shower curtain. The brackets used to support the roll tube, the roll tube, the handle, the glides and many other features can be identical. The frame may change depending on the installation since a window frame and a shower curtain frame are different by nature.

As many changes can be made to the preferred embodiments of the invention without departing from the scope thereof. It is intended that all matter contained herein be considered illustrative of the invention and not in a limiting sense.

The embodiments of the invention in which an exclusive property or privilege is claimed are as follows:

1. A method of advertisement for a shower closure comprising:

i) providing a roll out shower curtain disposed with a frame that provides a flat planar surface on said curtain when fully extended;

ii) providing a replaceable advertisement on said surface of said curtain;

iii) providing each edge of the curtain with a curtain connector;

iv) providing a handle and roll tube to attach to the curtain connector;

v) displaying the replaceable advertisement by moving the curtain to and from an operative position in the frame;

vi) replacing the advertisement when desired by removing the curtain connector from the handle and roll tube;
wherein the advertisement may be conveniently displayed and replaced as desired.

2. The use of a shower closure for displaying replaceable advertisements to the public, said shower closure being selected from a curtain, a door, and a roll out curtain:

i) affixing the replaceable advertisement to the closure;

ii) displaying the advertisement for a predetermined period of time;

iii) replacing the advertisement as desired;
wherein an occupant is exposed to a unique form of advertising heretofore unknown.

3. A method of advertising in a shower comprising:

providing replaceable advertisements on a shower closure, said closure being selected from a door, curtain and a roll Out curtain:

i) affixing the replaceable advertisement to the closure;

ii) displaying the advertisement for a predetermined period of time;

iii) replacing the advertisement as desired;

wherein an occupant is exposed to a unique form of advertising heretofore unknown.

4. A method of advertising in a shower comprising:

i) providing a replaceable advertisement for a closure of a shower enclosure selected from one of the group of a shower door, a shower curtain, and a roll out shower curtain;

ii) affixing the replaceable advertisement to the closure;

iii) displaying the advertisement for a predetermined period of time;

iv) replacing the advertisement as desired;
wherein an occupant is exposed to a unique form of advertising heretofore unknown.

5. A novel use of a shower closure as an advertising display, said closure selected from a shower curtain, a shower door, or a roll out shower curtain, wherein said shower closure is utilized as an advertising display, said display being replaceable as desired:

i) affixing the replaceable advertisement to the closure;

ii) displaying the advertisement for a predetermined period of time;

iii) replacing the advertisement as desired;
wherein an occupant is exposed to a unique form of advertising heretofore unknown.

6. The method or the use of claim 4 or 5 further comprising a roll out shower curtain.

7. The method or use of claim 6 further comprising a curtain construction including a flexible key element located proximate each end of the curtain panel, the element easily engaging with a slot provided within both the roll tube and the handle of the roll out curtain assembly.

8. The method or use of claim 7 wherein the flexible key element located adjacent each end of the shower curtain panel includes a head and a tail separated by a flexible zone which accommodates flexing when the roll out shower curtain is moved between operative and inoperative positions.

9. A method of displaying an advertisement in a shower closure comprising:

i) providing a roll out shower curtain structure that provides a flat planar surface when said curtain is fully extended;

ii) providing a replaceable advertisement on said panel;

iii) providing each edge of the curtain with a curtain connector;

iv) providing a handle and roll tube to attach to the curtain connector;

v) displaying the replaceable advertisement by moving the curtain to an operative position;

vi) replacing the advertisement when desired by removing the curtain connector from the handle and roll tube;
wherein the advertisement may be conveniently displayed and replaced as desired.

* * * * *